US009394902B2

(12) United States Patent
Wheeler

(10) Patent No.: US 9,394,902 B2
(45) Date of Patent: Jul. 19, 2016

(54) ROTARY FLUID MACHINE AND ASSOCIATED METHOD OF OPERATION

(71) Applicant: Greystone Technologies Pty. Ltd., Welshpool (AU)

(72) Inventor: Daryl Wheeler, Silver Sands (AU)

(73) Assignee: GREYSTONE TECHNOLOGIES PTY. LTD., Welshpool (AU)

( * ) Notice: Subject to any disclaimer, the term of this patent is extended or adjusted under 35 U.S.C. 154(b) by 0 days.

(21) Appl. No.: 14/414,736

(22) PCT Filed: Dec. 12, 2013

(86) PCT No.: PCT/AU2013/001459
§ 371 (c)(1),
(2) Date: Jan. 14, 2015

(87) PCT Pub. No.: WO2014/089629
PCT Pub. Date: Jun. 19, 2014

(65) Prior Publication Data

US 2015/0192122 A1 Jul. 9, 2015

(30) Foreign Application Priority Data

Dec. 12, 2012 (AU) ..... 2012905433

(51) Int. Cl.
*F04C 2/00* (2006.01)
*F04C 2/344* (2006.01)
*F01C 21/08* (2006.01)
(Continued)

(52) U.S. Cl.
CPC ..... *F04C 2/344* (2013.01); *F01C 21/08* (2013.01); *F01C 21/0827* (2013.01); *F03C 2/304* (2013.01); *F03C 2/308* (2013.01);
(Continued)

(58) Field of Classification Search
CPC ..... F04C 2/344; F04C 2/3566; F04C 2/46; F04C 15/06; F04C 15/0007; F01C 21/08; F01C 21/0827; F03C 2/304; F03C 2/308
USPC ..... 418/243
See application file for complete search history.

(56) References Cited

U.S. PATENT DOCUMENTS 3,343,526 A 9/1967 Peras
4,006,804 A 2/1977 Fehr
(Continued)

OTHER PUBLICATIONS

PCT/AU2013/001459 International Search Report dated Mar. 3, 2014 (8 p.).
(Continued)

*Primary Examiner* — Thomas Denion
*Assistant Examiner* — Thomas Olszewski
(74) *Attorney, Agent, or Firm* — Conley Rose, P.C.

(57) ABSTRACT

A fluid rotary machine includes first and second bodies and that are rotatable relative to each other. The second body is inside the first body to define a working fluid space there between. In addition, the machine includes a plurality of gates. Each gate 18 is supported by the first body and is movable in a radial direction with respect to the first and second bodies to extend into and retract from the working fluid space. The machine also includes a magnetic gate control system configured to exert control of the motion and/or position of the gates in the radial direction. The magnetic gate control system is a dispersed system including magnets or magnets and components made of ferromagnetic materials. The magnetic gate control system may be dispersed between the gates, and one or both of the bodies.

28 Claims, 20 Drawing Sheets

(51) Int. Cl.

| | |
|---|---|
| ***F03C 2/30*** | (2006.01) |
| ***F04C 2/356*** | (2006.01) |
| ***F04C 2/46*** | (2006.01) |
| ***F04C 15/06*** | (2006.01) |
| ***F04C 15/00*** | (2006.01) |

(52) U.S. Cl.
CPC ..... *F04C 2/3566* (2013.01); *F04C 2/46* (2013.01); *F04C 15/0007* (2013.01); *F04C 15/06* (2013.01)

(56) References Cited

U.S. PATENT DOCUMENTS

| | | | | |
|---|---|---|---|---|
| 5,135,372 | A | 8/1992 | Pipalov | |
| 6,468,061 | B2 | 10/2002 | Dyktynski et al. | |
| 6,589,033 | B1 * | 7/2003 | Johnson | F01C 11/004 418/13 |
| 8,821,365 | B2 * | 9/2014 | Ozaki | F04D 13/0666 600/16 |
| 2007/0031278 | A1 * | 2/2007 | Edwards | F01C 21/0836 418/161 |
| 2010/0098570 | A1 * | 4/2010 | Bodart | F04C 29/021 418/55.1 |
| 2012/0051958 | A1 * | 3/2012 | Santos | F01C 21/0836 418/1 |
| 2013/0045124 | A1 * | 2/2013 | Subiantoro | F01C 1/348 418/159 |

OTHER PUBLICATIONS

PCT/AU2013/001459 Written Opinion of the International Preliminary Examining Authority dated May 8, 2014 (8 p.).

* cited by examiner

ROTARY FLUID MACHINE AND ASSOCIATED METHOD OF OPERATION

CROSS-REFERENCE TO RELATED APPLICATIONS

This application is a 35 U.S.C. §371 national stage application of PCT/AU2013/001459 filed Dec. 12, 2013 and entitled "A Rotary Fluid Machine and Associated Method of Operation," which claims priority to Australian Application No. 2012905433 filed Dec. 12, 2012 and entitled "A Rotary Fluid Machine and Associated Method of Operation," both of which are hereby incorporated herein by reference in their entirety for all purposes.

STATEMENT REGARDING FEDERALLY SPONSORED RESEARCH OR DEVELOPMENT

Not applicable.

BACKGROUND

1. Technical Field

A rotary fluid machine and a method of operating the machine are disclosed. The rotary fluid machine that may be operated as either a pump or a motor.

2. Background Art

One type of rotary fluid machine comprises a rotor and a stator, one fitted inside the other so as together define a working fluid space. A plurality of lobes is formed on one of the rotor or the stator, and a plurality of gates is supported by the other. Inlet and outlet ports are provided on opposite sides of each lobe to allow fluid to flow into and out of the working fluid space. The machine can function as a pump or a motor. In particular by driving the rotor with say an electric motor the machine can act as a pump. Alternately by supplying a high pressure fluid to the inlet ports the machine can operate as a motor.

While there is rotation between the rotor and the stator the gates are moved between respective extended (or sealing) and retracted positions dependent on the relative juxtaposition of the rotor and the stator. When a gate is passing a lobe crest, the gate will be in its retracted position. Conversely when a gate is disposed between adjacent lobe crests it will be in its partly or fully extended position. In order to maintain optimum operational efficiency it is preferable that the gates are in close proximity to or in contact with the non-supporting body for at least the portion of their travel between mutually adjacent inlet and outlet ports particularly while the gates are in a fully extended position. To this end the rotary fluid machine is provided with a gate control system that operates to control the motion of a gate and in particular to at least move, urge or otherwise bias the gates to their fully extended positions. The gate control system may comprise for example a plurality of cams one on each side of each gate, and corresponding cam tracks in which the cams run. By appropriate profiling the cam tracks the gates are moved or pulled to their fully extended (sealing) position when there is relative motion between the rotor and stator. The gate control system may also operate to move, urge or otherwise bias the gates to the retracted position. However this function can additionally or alternately be provided by the non-supporting body itself which mechanically push the gates to their retracted positions.

For example assume the machine is configured or operated as a pump and the gates are supported by the rotor. The gate control system operates to maintain the gates in close proximity to, or in contact with a surface of the stator. This is desirable on the suction side in order to draw fluid from a supply through the inlet port. Gate position control is also important on a discharge side to maximise discharge pressure and flow rate.

SUMMARY OF THE DISCLOSURE

The general idea of a first aspect of the presently disclosed rotary fluid machine is to magnetically control the motion and/or position of the gates in the machine. This avoids the need for a mechanical gate control system. This in turn simplifies the construction and design of the machines and eliminates numerous failure modes.

Thus in embodiments of the machine a magnetic gate control system is incorporated that is arranged to exert control of motion and/or position of the gates of the machine. The magnetic gate control system can be arranged for example, to control the motion of the gates so that they can be moved to their extended position. Indeed the magnetic gate control system may be arranged to levitate the gates at least in a radial direction so that sides of the gates in a radial plane do not contact other parts of the machine, thereby minimising wear. The magnetic control system is operable independent of the type of gate. For example the magnetic control system may be used to control motion of a sliding vane type gate or a pivoting or swinging gate.

The general idea and concept behind a second aspect of the machine is the provision of a fluid rotary machine where the number of gates is not an integer number multiple of the number of lobes. In this aspect, the machine may have either a magnetic gate control system in accordance with the first aspect, or a mechanical gate control system. It is believed that providing the machine with such an arrangement of gates and lobes provides smoother and quieter operation.

In a first aspect there is disclosed a rotary fluid machine comprising:

first and second bodies, the bodies being rotatable relative to each other and arranged one inside the other to define a working fluid space there between;

at least one gate carried by or otherwise coupled with the first body and movable with respect to the bodies to extend into and retract from the working fluid space; and a magnetic gate control system operable to exert control of motion of the or each gate.

In one embodiment the magnetic gate control system is operable to move the at least one gate in an extension direction to extend the at least one gate from the first body toward the second body.

In one embodiment the magnetic gate control system is operable to move the at least one gate in a retraction direction to retract the at least one gate toward the first body.

In one embodiment the magnetic gate control system is operable to move the at least one gate in either one or both of: (a) an extension direction to extend the at least one gate from the first body toward the second body; and (b) a retraction direction to retract the at least one gate toward the first body.

In one embodiment the magnetic gate control system is arranged to produce a magnetic attraction force between the gates and the second body to move the at least one gate in the extension direction.

In one embodiment the magnetic gate control system is arranged to produce a magnetic repulsion force between the gates and the first body to move the at least one gate in the extension direction.

In one embodiment the magnetic gate control system is arranged to produce one or both of (a) a magnetic attraction force between the gates and the second body to move the at least one gate in the extension direction; and (b) a magnetic repulsion force between the gates and the first body to move the at least one gate in the extension direction.

In one embodiment the magnetic gate control system is arranged to produce a magnetic attraction force between the gates and the first body to move the at least one gate in the retraction direction.

In one embodiment the magnetic gate control system is arranged to produce a magnetic repulsion force between the gates and the second body to the at least one gate in the retraction direction.

In one embodiment the magnetic gate control system is arranged to produce one or both of (a) a magnetic attraction force between the gates and the second body to move the at least one gate in the extension direction; and (b) a magnetic repulsion force between the gates and the first body to move the at least one gate in the extension direction.

In one embodiment the magnetic gate control system comprises one or more magnets fixed to one or both of the first body and the second body.

In one embodiment the magnets are permanent magnets.

In one embodiment the magnets are rare earth magnets.

In one embodiment the magnets are hermetically sealed on the body or bodies to which they are fixed.

In one embodiment the magnetic gate control system comprises a plurality of magnets arranged in Halbach array.

In one embodiment the one or more magnets fixed to the second body comprise a first set at least one magnet arranged to apply a force of attraction to displace the gates toward the second body.

In one embodiment the one or more magnets fixed to the second body comprise a second set at least one magnet arranged to apply a force of repulsion to displace the gates toward the first body, the second set of magnets being on side of the first set of magnets.

In one embodiment the one or more magnets fixed to the second body comprise a third set at least one magnet arranged to apply a force of attraction to hold the gates near the second body, the third set of magnets being on a side of the first set of magnets opposite the second set.

In one embodiment the second body is provided with a lobe having a crest that lies in close proximity to the first body and the first set of at least one magnet extends along one side of the lobe toward the crest.

In one embodiment the second set of at least one magnet extends along an opposite side of the lobe toward the crest.

In one embodiment the third set of at least one magnet extends from the first set of magnets distant the crest.

In one embodiment the one side of the crest leads to an adjacent constant diameter portion of the second body and wherein the first set of magnets comprises a first one piece magnet that spans from a first location adjacent the crest to a second location adjacent the fixed diameter portion and wherein the first one piece magnet has a constant or variable magnetic field in the direction of rotation between the first and second locations.

In one embodiment each one piece magnet has a planar base on a radial inner side of the one piece magnet that is inclined relative to a tangent plane of an immediately adjacent portion of the second body.

In one embodiment the first one piece magnet has a radial outer surface of a profile substantially the same as that of the one side of the lobe.

In one embodiment at least one further one piece magnet, each further one piece magnet being substantially identical to the first one piece magnet and wherein the one piece magnets are in axial alignment across the one side of the lobe.

In one embodiment the lobe is one of a plurality of lobes, and wherein each lobe is provided with a like arrangement of magnets.

In one embodiment the gate is made of a ferromagnetic material and the gate forms part of the magnetic gate control system.

In one embodiment the gate is a magnet and the gate forms part of the magnetic gate control system.

In one embodiment the gate is provided with one or more gate magnets and the gate magnets form part of the magnetic gate control system.

In one embodiment the gates are tapered on opposite radially extending sides in a manner so that an axially extending side of the gate closest the second body is shorter in length than an opposite axially extending side of the gate.

In one embodiment the magnetic gate control system is further arranged to space the gates from opposite radial sided of the first body.

In one embodiment the rotary fluid machine comprises M gates where M is an integer, wherein the second body is provided with N lobes wherein M>N and M/N is a non-integer>1.

In one embodiment the magnets are electro-magnets.

In one embodiment the machine is bi-directional.

In a second aspect there is disclosed a rotary fluid machine comprising:

first and second bodies, the bodies being rotatable relative to each other and arranged one inside the other to define a working fluid space there between, the second body being provided with N lobes where N is a integer>1, each lobe having a crest lying in close proximity to or touching the first body to divide the working fluid space into a plurality of chambers;

M gates where M is a integer>1 and wherein M>N and M/N is a non-integer greater than 1, the gates being supported by the first body and movable with respect to the bodies to extend into and retract from the working fluid space; and a gate control system operable to exert control of motion of the at least one gate.

In one embodiment the gate control system is a magnetic gate control system operable to exert control of motion of the at least one gate.

In a third aspect there is disclosed a method of operating a rotary fluid machine having first and second bodies, the bodies being rotatable relative to each other and arranged one inside the other to define a working fluid space there between, and at least one gate, the at least one gate being carried by or otherwise coupled with the first body and movable to extend into and retract from the working fluid space, the method comprising magnetically controlling motion of the gates for at least one portion of a cycle of the rotation of one of the bodies relative to the other.

In one embodiment magnetically controlling motion of the gates comprises magnetically biasing the gates to move in an extension direction toward the second body for a plurality of first portions of the cycle of rotation.

In one embodiment magnetically controlling motion of the gates comprises magnetically biasing the gates to move in a retraction direction toward the first body for a plurality of second portions of the cycle of rotation, wherein the second portion are interleaved with the first portions.

In one embodiment magnetically controlling motion of the gates comprises providing one or more magnets in or on the second body to produce a magnetic field capable of inducing motion of gates.

In one embodiment magnetically controlling motion of the gates comprises providing one or more magnets in or on the first body to produce a magnetic field capable of inducing motion of gates.

In one embodiment magnetically controlling motion of the gates comprises providing one or more magnets in or on the gates to produce a magnetic field capable of inducing motion of gates.

In one embodiment magnetically controlling motion of the gates comprises using gates made of a ferromagnetic material.

In one embodiment when a plurality of magnets is provided, the method comprises arranging the magnets in a Halbach array.

In one embodiment the method comprises magnetically levitating the gates.

In a fourth aspect there is disclosed a rotary fluid machine comprising:

first and second bodies, the bodies being rotatable relative to each other and arranged one inside the other to define a working fluid space there between;

at least one gate carried by or otherwise coupled with the first body and being movable with respect to the bodies;

at least one lobe on the second body across which the at least one gate traverses; and a gate control system operable to exert control of motion of the at least one gate;

wherein each lobe is provided with a lobe surface across which a gate traverses when the first body is rotating relative to the second body, the lobe surface provided with: openings to form one or more inlets and outlets for the working fluid; and a plurality of relatively raised and relatively recessed surfaces arranged such that an adjacent end of a gate traversing the lobe surface is subjected to substantially uniform wear across an entirety of a length of the gate that co-extends with an axial width of the lobe.

In one embodiment each lobe is separately formed of the second body.

In one embodiment the second body is provided with a constant diameter portion between rotationally adjacent lobes across which of the at least one gate traverses and wherein each constant diameter portion of formed by a lining block and wherein each lining block is formed separately of the second body.

In one embodiment the first body comprises a working surface that faces the second body and wherein the working surface is composed of a plurality of mutually adjacent separately formed first body lining blocks.

In one embodiment the first body lining blocks are spaced apart to form a throat for each recess that narrows in the radial direction toward the axis of rotation.

In a fifth aspect there is disclosed a rotary fluid machine comprising:

first and second bodies, the bodies being rotatable relative to each other and arranged one inside the other to define a working fluid space there between;

at least one gate carried by or otherwise coupled with the first body and being movable with respect to the bodies; and a gate control system operable to exert control of motion of the at least one gate;

wherein one or both of the first and second bodies comprise a respective super structure and one or more separately made lining blocks detachably coupled to the respective super structure, wherein each of the lining blocks have respective surfaces that face and form part of the working fluid space.

The embodiment features of the first and second aspect may be incorporated in each of the fourth and fifth aspects of the rotary fluid machine. For example the magnetic gate control system may be incorporated in the fourth or fifth aspects of the rotary fluid machine.

Additionally or alternately the relationship between the number of lodes and gates of the first or second aspects may be incorporated in the fourth or fifth aspects.

BRIEF DESCRIPTION OF THE DRAWINGS

Embodiments of the fluid rotary machine and associated method of operation will now be described by way of example only with reference to the accompanying drawings in which.

DETAILED DESCRIPTION OF PREFERRED EMBODIMENTS

Figure 1:
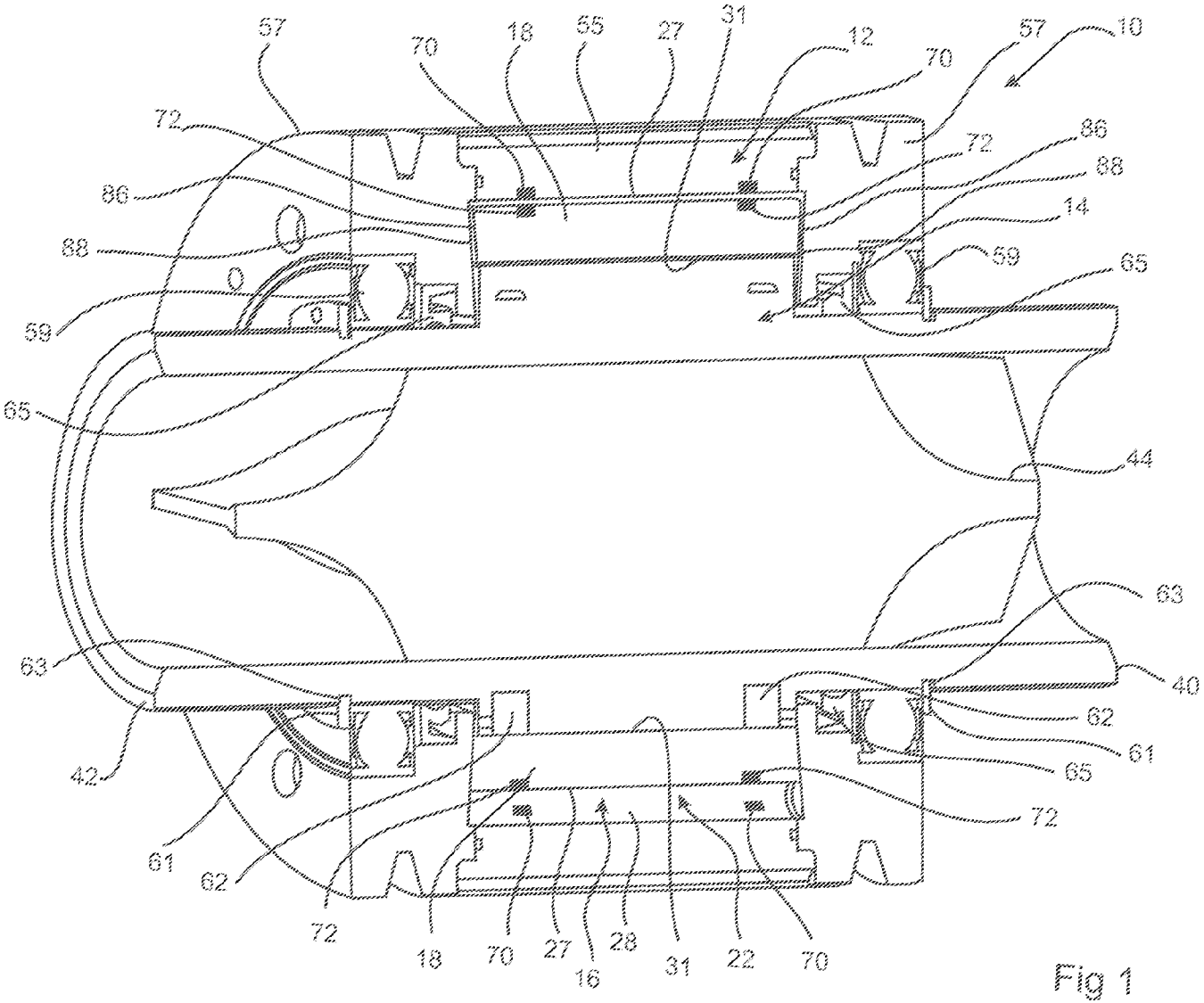
FIG. 1 is an axial section view of a first embodiment of the rotary fluid machine.
Figure 2:
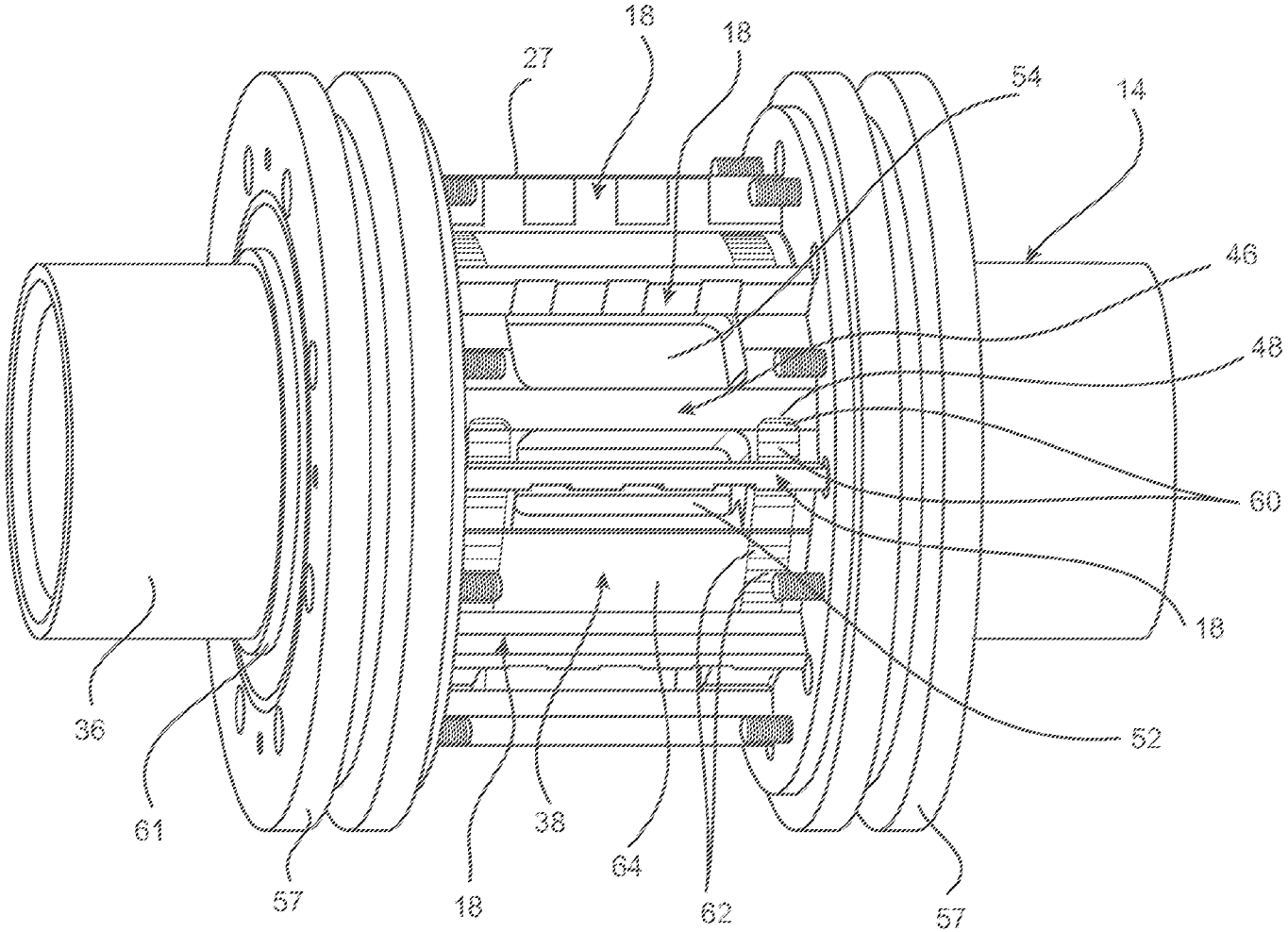
FIG. 2 is an isometric view from the side of a stator and end caps of the machine shown in FIG. 1.

With reference to FIGS. 1-5 an embodiment of a fluid rotary machine 10 comprises first and second bodies 12 and 14 that are rotatable relative to each other. One of the bodies, namely body 14 is inside the other body 12 to define a working fluid space 16 there between (see in particular FIG. 4). In this embodiment the machine 10 has at least one, and in particular eight gates 18*a*-18*h* (hereinafter referred to in general as "gates 18" in the plural or "gate 18" in the singular). Each gate 18 is carried by or otherwise coupled with the first body 12 and is movable in opposite directions toward the second body or toward the first body. Motion toward the second body and consequently into the working fluid space 16 may be considered as an extension motion, or motion in an extension direction. Conversely motion toward, including into, the first body and consequently out of the working fluid space 16 may be considered as a retraction motion, or motion in a retraction direction.

The machine 10 also comprises a magnetic gate control system that is operable to exert control of the motion and/or position of the gates 18. The magnetic gate control system is a dispersed system in that it comprises a combination of: magnets; or magnets and components made of ferromagnetic materials. While this will be discussed in greater detail below, the magnetic gate control system may be dispersed between the gates 18, and one or both of the bodies 12 and 14.

For ease of description the gates 18 in most of the embodiments of the present machine and method are shown and described as vane type gates that move in a radial direction so as to extend radially toward the second body 14; and retract radially toward or into the first body 12. However the magnetic gate control system is equally operable and effective for embodiments of the present machine and method that incorporate pivoting or swinging type gates as will be briefly described later in this specification with reference to FIG. 22.

Figure 4:
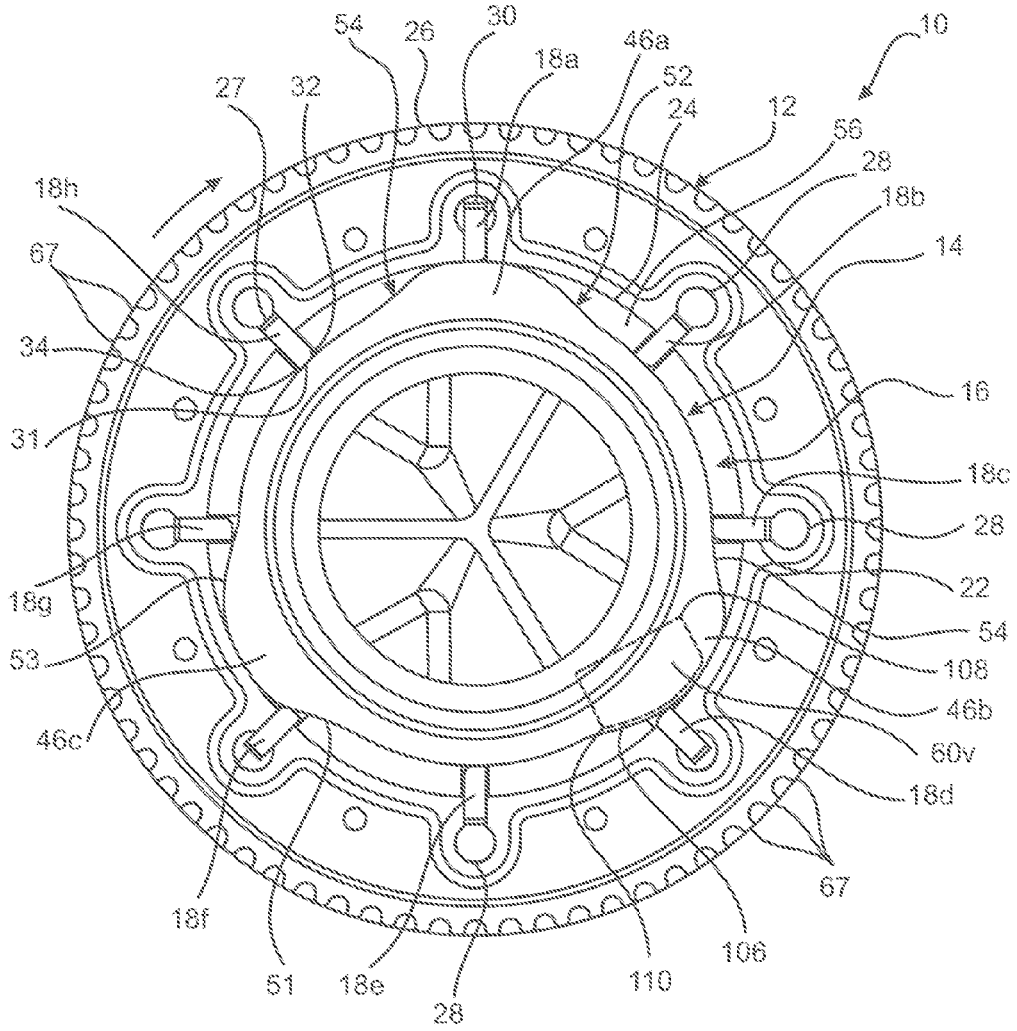
FIG. 4 is an end view of the machine shown in FIG. 1 with the end caps removed.

The machine 10 operates by virtue of relative rotation between the bodies 12 and 14. To simplify the description of the present embodiment the first or outer body 12 may also be herein after described as a rotor (i.e. a body that rotates) while the second or inner body 14 may be described as a stator (i.e. a body that is stationary). With particular reference to FIG. 4, the rotor 12 is provided with a plurality of radially extending slots 22 for receiving respective gates 18. Each slot 22 extends from an inner circumferential surface 24 toward the outer circumferential surface 26 of the rotor 12. A radially outermost end of each slot 22 terminates in an arcuate cavity 28. Each slot 22 is of a depth greater than the radial length of the gates 18. Therefore when a gate 18 is in its fully retracted position a space 30 exists between the radially distant side 27 of the gate 18 and the inner surface of the cavity 28. The gates 18 are evenly spaced circumferentially about the rotor 12. Thus in this instance the gates 18 are spaced by 45° from each other. In this embodiment the machine 10 is asymmetrical in that the rotor 12 can rotate in only one direction (clockwise in this example) about the stator 14. A radially inner most end 31 of each gate has a convex curved leading bottom edge 32 and a substantially square trailing edge 34.

The stator 14 comprises a conduit 36 and a second body super structure in the form of a hub 38 integrally formed on an outer circumferential surface of the conduit 36. The conduit 36 has an intake 40 at one axial end and an exhaust 42 at an opposite end. Disposed within the conduit 36 is a manifold 44 that is used to provide an even distribution of fluid through the machine 10.

The hub 38 (i.e. the second body super structure) is provided with three lobes 46*a*, 46*b* and 46*c* (hereinafter referred to in general as "lobes 46"). Each lobe has a crest 48 provided with an arcuate surface 50. The crests 48 lie in very close proximity to or may lightly touch the inner circumferential surface 24 of the rotor 12. Moreover, the lobes 46 form substantial seals against the circumferential surface 24. It is not a requirement and indeed is not practical to form a perfect seal between the lobes 46 and the inner circumferential surface 24. A respective inlet/suction port 52 opens onto one side of each lobe 46 while a respective outlet/high pressure port 54 opens onto the side of each lobe 46. When the machine operates as a pump it may be more appropriate to designate the port 52 as a suction port, and the port 54 as a high pressure port. Conversely when the machine operates as a motor it may be more appropriate to designate the port 52 as an inlet port and the port 54 as the outlet port. However for simplicity of description the ports 52 will be termed as inlet ports and the ports 54 will be termed as outlet ports irrespective of whether the machine 10 is operated as a pump or motor.)

The inlet port 52 and outlet port 54 communicate between the working fluid space 16 and the conduit 36. With respect to the conduit 36, the inlet ports 52 and the outlet ports 54 are isolated from each other by the manifold 44. Fluid entering the intake 40 is directed by the manifold 44 into the inlet ports 52 and subsequently after flowing through the working fluid space 16 flows through the outlet ports 54 and is directed by the manifold 44 to the exhaust 42.

Figure 5:
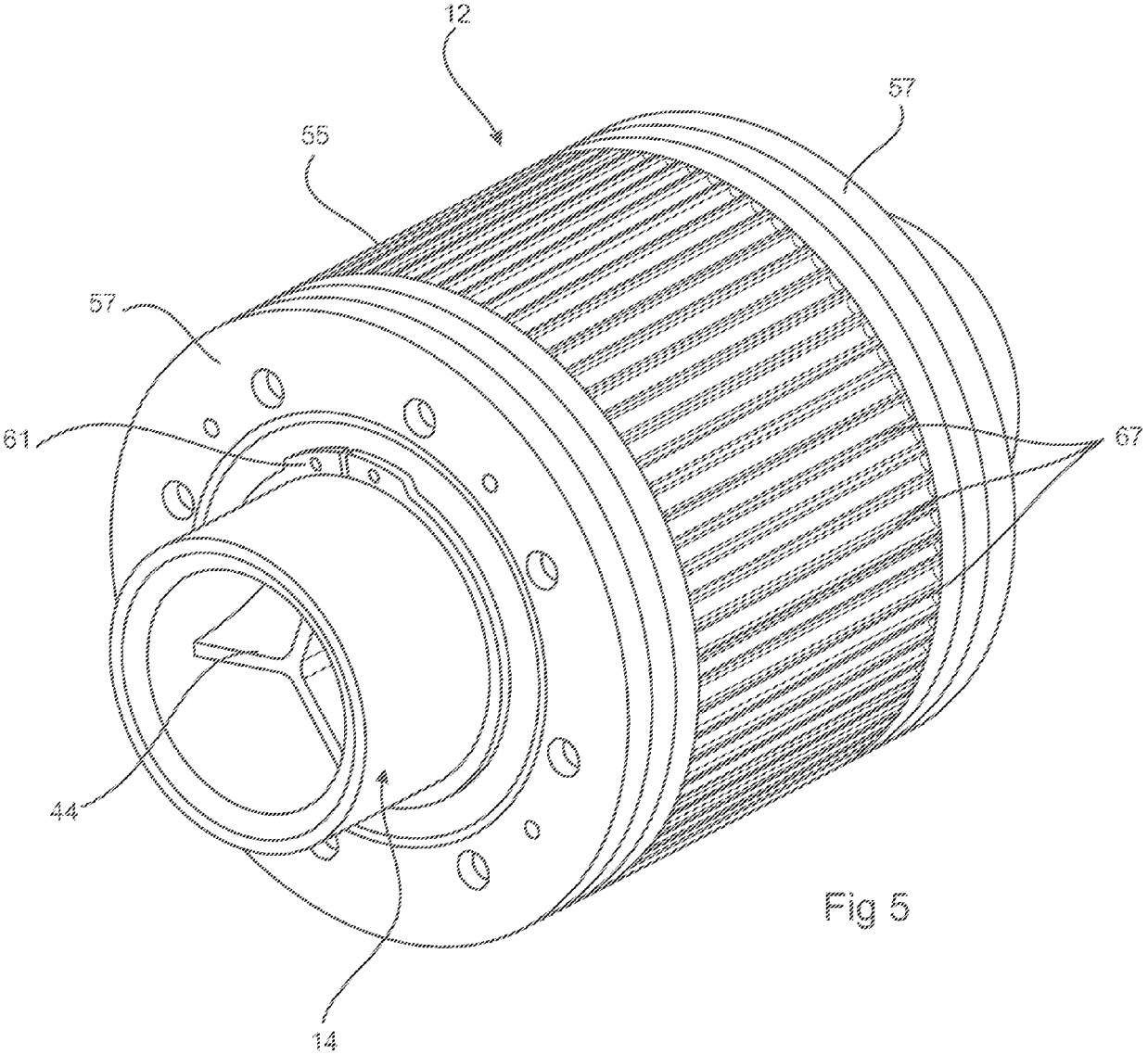
FIG. 5 is an isometric view of the machine shown in FIG. 1.

With reference to FIGS. 1 and 5 the rotor 12 comprises a central cylindrical ring 55 and end plates 57 bolted one to each side of the ring 55. The end plates are supported by bearings 59 fitted to the conduit 36 on opposite sides of the hub 38. This enables relative rotation between the rotor 12 and stator 14. Circlips 61 seat in circumferential grooves 63 formed in and about the conduit 36 to prevent axial movement of the bearings 59 away from their respective end plates 57. Sealing rings 65 are fitted between the bearings 59, plates 57 and conduit 36 to prevent leakage of fluid form the machine 10. A plurality of gear teeth 67 is formed on the outer circumferential surface of the ring rotor and in particular the ring 55. The teeth 67 extend in the axial direction and are evenly spaced about the ring 55.

In this example of the machine 10, there are three lobes 46 and eight gates 18. Thus the number of gates 18 is non-integer multiple of the number of lobes 46. The significance of this will be described later in the specification.

The general operation of the machine 10 is as follows. Assume that the machine 10 is being used as a pump to pump a liquid and that before start up the pump is devoid of liquid i.e. has not been primed. The rotor 12 can in one example be driven by an electric motor coupled by a toothed belt that engages the teeth 67 on the outer circumferential surface 26. When torque is provided to the rotor 12 it commences to rotate in the clockwise direction. Assume also that the machine 10 is in the configuration shown in FIG. 4 with the gate 18*a* in the retracted position. The gate 18*a* may be in close proximity to the crest 48 of lobe 46*a*. It is not necessary for the gate 18*a* to be touching the crest 48 or the lobe 46*a* as the lobe 46*a* itself forms a substantial seal with the rotor 12. Indeed wear of the machine 10 is reduced if there is no contact between the gates 18 and the lobes 46. The gate 18*a* passes across the inlet port 52 adjacent lobe 46*a* and travels toward the outlet port 54.

The gate control system acts to at least initially bias the gate 18*a* to a location near the surface of the stator 14 between the ports 52 and 54 to form a substantial (although not necessarily absolutely perfect) seal. This creates suction between the peak 48 of lobe 46*a* and the rotating gate 18*a*. This suction draws liquid from a supply in fluid communication with the intake 40 through that inlet port into the sub chamber between the lobe 46*a* and that gate. Thus when the machine is operated as a pump the inlet ports 52 act as suction ports and, the side of corresponding lobes 46 in the direction of rotation up to the next downstream gate 18 is designated as the suction side of the lobe. (In a more general sense each lobe 46 has an ascending side 51 and a descending side 53 on opposite sides of the crest 48. The ascending side 51 is the side of a lobe on which the gate 18 rides up and thus retracts into its corresponding slot 22. The descending side 53 is the side of a lobe on which the gate 18 rides down and thus extends from its corresponding slot 22. Thus the relative direction of rotation between the bodies determines which side is the ascending side 51 and which is the descending side 53.). The creation of suction will also be occurring by similar action of other gates traversing across the hub 38 on the suction side of the other lobes.

As the rotor continues to rotate the upstream gate 18*h* will ride up lobe 46*a* and subsequently past the corresponding suction (i.e. inlet) port 52 while the gate 18*a* will pass the outlet port 54 of the lobe 46*b*. Now liquid being carried between the gates 18*h* and 18*a* is forced to flow through the high pressure (i.e. outlet) port 54 of lobe 46*b* and is discharged from the exhaust 42 (or more appropriately "discharge end" when the machine is a pump). This process will also be occurring albeit with different timing in the sub chambers 56 between mutually adjacent lobes 46. The pump is now primed and moreover has been self-primed.

Continued rotation of the rotor 12 results in a continuation of liquid being drawn through the inlet/suction ports 52 and being discharged through the outlet/high pressure ports 54. Thus the rotation of the rotor 12 effectively pumps liquid from the intake 40 to the exhaust 42.

Fluid flow through the machine 10 is essentially axial. In this regard fluid enters the machine 10 through the intake 40 and is divided by the manifold 44 to provide substantially equal fluid flows in terms of pressure and volume to each of the inlet ports 52. This fluid then flows into the working fluid space 16. When the machine 10 is being used as a pump, this fluid is swept by the rotation of the rotor 12 to the outlet port 54 of the next adjacent lobe 46. During rotation of the rotor 12, the gates 18 are moved or otherwise urged toward their fully extended position where they are in close proximity to or indeed touch the outer circumferential surface of the hub 38.

The operation and structure of the magnetic gate control system will now be described in greater detail but in the context of the machine 10 in general rather than in the context of the machine being operated as a pump or a motor.

In general terms, the magnetic gate control system controls the motion and/or location of the gates 18. Moreover the magnetic gate control system is operable to control the motion of the gates 18 within their slots 22 and/or position the gates 18 for the entirety of a cycle of the machine or for selected portions of a cycle. Examples of such portions of a cycle include but are not limited to the periods when a gate 18 is traversing: (a) a descending side 53 of a lobe; (b) the ascending side 51 and descending side 53 of the same lobe; and (c) a descending side 53 of one lobe and adjacent constant diameter portion of the stator up to the commencement of the ascending portion of the next lobe.

The magnetic control system may operate to move or bias the gates 18 to their respective fully extended positions so that the edges 32, 34 of the gates 18 are maintained in close proximity to or touch the outer circumferential surface of the hub 38 or at least various portions thereof. The magnetic gate control system may also operate to move or bias a gate 18 in a radially outward direction so as to retract into or toward its slot 22 for selected portions of a machine cycle. Further, the magnetic gate control system may operate by applying either a magnetic attraction force, or a magnetic repulsion force, or a simultaneous combination of both in order to move and control the position of a gate 18.

FIGS. 1-4 illustrate one form of the magnetic gate control system. The magnetic gate control system comprises a plurality of magnets 60 and 62 embedded in the hub 38. The magnets 60 are embedded on axially opposite ends of the inlet port 52. The magnets 60 extend from the crest 48 of the lobe 46 toward a constant diameter portion 64 of the stator 14. In this embodiment the last of magnets 60 is located at a position where the lobe 46 transitions to the constant diameter portion 64 of the hub 38. The magnets 62 are embedded in the hub 38 at axially opposite ends of the constant diameter portion 64 and extend to the commencement of the outlet port 54 of the rotationally next lobe 46 (in this instance lobe 46*b*).

The magnets 60 and 62 may be configured in a Halbach array. A Halbach array is an arrangement of permanent magnets that concentrates the magnetic field on one side of the array while reducing the magnetic field on an opposite side. In this embodiment the magnets 60 and 62 are formed in a Halbach array in a manner so that magnetic flux is concentrated to extend substantially perpendicular to the exposed face of the magnets 60 embedded in the stator 14. In one embodiment the individual magnets 60 and 62 are rare earth magnets such as neodymium or samarium-cobalt magnets. In order to embed the magnets 60 in the hub 38 each individual magnet 60 and 62 may require individual shaping (shown in FIG. 7*a*) so that when adjacent magnets 60, 62 are embedded their faces are in abutment. Opposite axial faces 66 of the hub 38 are formed with a plurality of holes 68 for receiving screws such as grub screws for holding the magnets 60, 62 in place. These are required when the magnets 60, 62 are arranged in a Halbach array as the array often requires magnetic faces of like poles to be adjacent each other.

The magnetic gate control system also comprises the gates 18 themselves, or further magnets embedded in the gates 18. When the magnets 60, 62 are arranged in a Halbach array then the magnetic gate control system is completed by forming the gates 18 of a ferromagnetic material; that is a material that is attracted by the magnetic field produced by the magnets 60, 62. Thus with reference to FIG. 4, assuming the gate 18*a* is made from a ferromagnetic material, the magnetic gate control system exerts control of the motion of the gate 18 by causing it to move in a radial direction toward the hub 38. In the absence of any other influence or force, the gate 18*a* will be held in near or in contact with the hub 38 while the rotor 12 is rotated by virtue of the magnetic attraction of the gate 18*a* to the magnets 60, 62. When the rotor 12 is rotated to a position where the gate 18*a* commences to ride up the lobe 46*b* and across the outlet port 54, the gate 18*a* is mechanically or physically pushed by the lobe 46*b* and/or thrown out by centrifugal force in a radial direction back into its corresponding slot 22. Thus when the gate 18*a* is at the crest 48 of lobe 46*b* the gate 18*a* is in its fully retracted position. The arrangement of magnets 60, 62 is the same on the inlet side of the lobe 46*b*. Thus upon continued rotation of the rotor 12 the gate 18*a* is now again moved and controlled by the magnetic gate control system so as to slide in the radial direction in its corresponding slot toward its extended position.

In the above embodiment, the magnetic gate control system operates to move the gates 18 to the extended position on the intake port side of the lobes 46. More particularly the magnets 60 operate to extend the gates 18 from their slots 22 and toward the surface of the constant diameter portion of the hub. The magnets 60 are not required to necessarily cause the gates 18 to touch the descending portions of the lobes 46. Rather as mentioned above benefits arise if the gates 18 are in close proximity to the lobes 46 while they are being extended from their slots 22. In practice a gate 18 and lobe 46 may be separated by a very thin film of the fluid passing through the machine 10.

The magnets 62 are optional rather than an absolute requirement. They act to hold the extended gates 18 in their position near or in light contact with the constant diameter portion of the hub to form a substantial seal. Depending on operating conditions fluid pressure in the machine 10 may in any event act to hold the gates 18 in the position to which they are initially biased and accelerated by the magnets 60 once past the inlet port of any corresponding lobe 46.

The magnets 60 and the magnets 62 (when provided) are hermetically sealed, if required, in and on the hub 38. This may be achieved by coating the hub 38 or at least portions of the hub 38 bearing the magnets 60, 62 with a curable epoxy resin. The requirement to hermetically seal the magnets 60, 62 is dependent upon the liquid passing through the machine 10. In an event that the liquid 10 is corrosive or otherwise may damage the magnets 60, 62 then hermetic sealing is preferable in order to extend life of the machine 10. This may occur for example when the machine 10 is used to pump water in a desalination plant. However if the machine 10 were used to pump for example oil, then it may not be necessary to provide the hermetic seal.

In the above described embodiment the magnetic gate control system operates to attract the gates 18 to their extended position on the descending portions of the lobes 46. In the absence of any other acting force or device, the gates 18 will touch the outer circumferential surface of the hub 38. However the magnetic gate control system may also be configured to hold the gates 18 in an extended position where they are marginally spaced from and thus do not physically contact the outer circumferential surface of the hub 38. This may be achieved for example by placing mutually repelling magnets in say the inside of the inlet ports 52 and at axially aligned locations on the radially inner most side 31 of each gate 18. Thus while the magnets 60 act to attract the gate 18 to the extended position, the repelling magnets provide an opposite force which act to force the gates 18 marginally away from a surface of the hub 38. This can prevent direct contact between the gates 18 and the hub 38; or at least cushion contact of the gates thereby minimising wear. Similarly, repelling magnets may be placed on the constant diameter portion 64 of the hub 38 inside of the magnets 62 to achieve the same effect.

The magnetic gate control system may also be arranged to produce a mutually repelling magnetic force between an inside surface of the cavity 28 of slots 22 and the radial outer most side 27 of the gates 18. In one example shown in FIG. 1 this is achieved by embedding magnets 70 in the ends 28 of slots 22 and embedding magnets 72 in the sides 27 of the gates 18. Thus this mutual repulsion biases the gates 18 to their extended positions.

Figure 6:
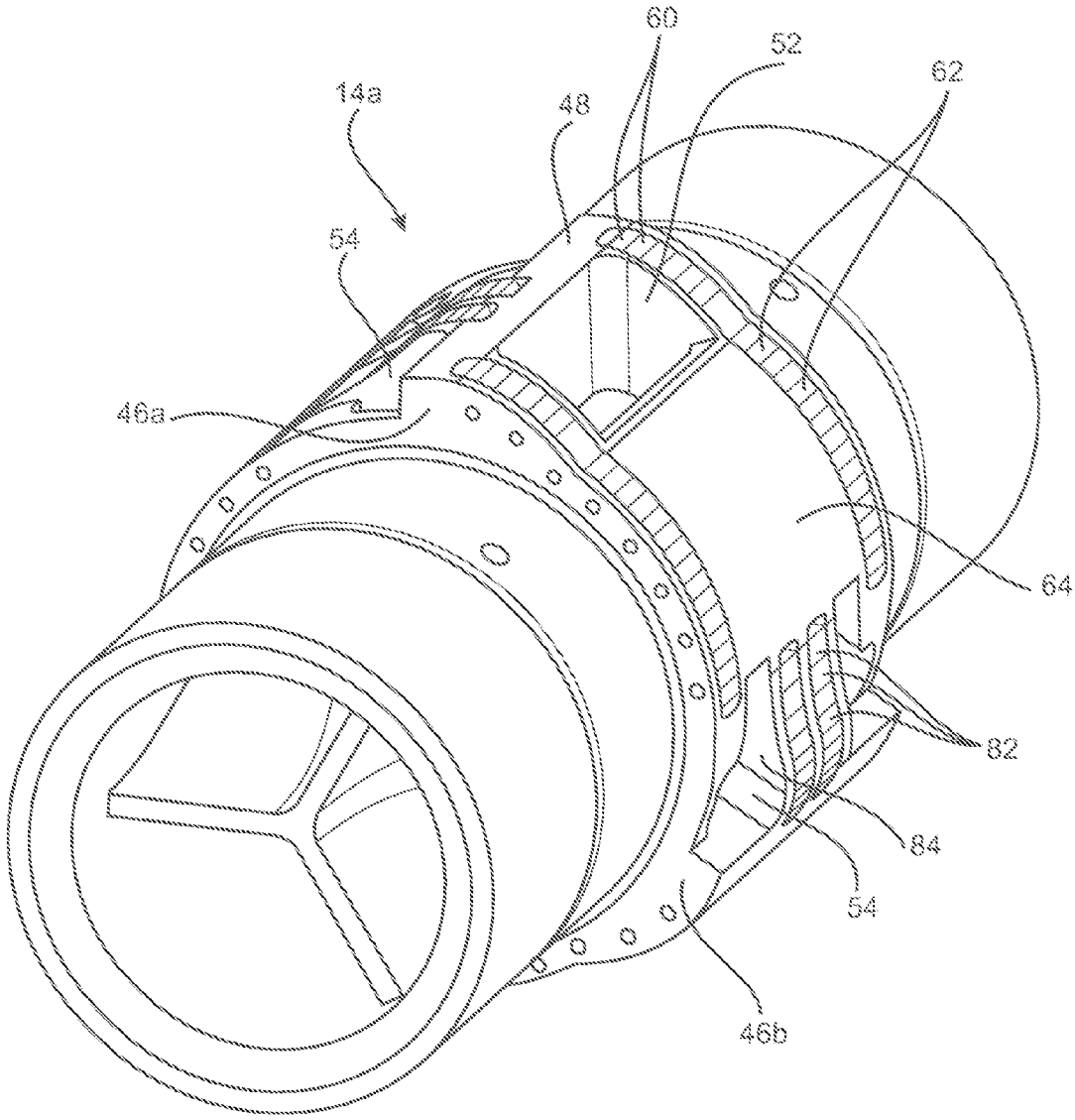
FIG. 6 is an isometric view of a stator incorporated in a second embodiment of the machine.

In a further variation or adaptation of the magnetic gate control system magnets 82 may also be arranged to extend across or adjacent to the outlet ports 54 as shown in FIG. 6. FIG. 6 shows a modified stator 14*a* that differs from the stator 14 by virtue of the configuration of the lobes 46. In the stator 14*a* the lobes 46 are configured on the intake side 52 in the same manner as the lobes 46 on the stator 14. However on a side of the outlets 54 the lobes 46 have a different configuration. In the stator 14*a* a smoothly curved ramp 84 extends in a circumferential direction through the middle of the outlet ports 54 providing a continuous surface from the constant diameter portions 64 to the crest 48 of the corresponding lobe 46. The profile of the ramps 84 is in essence the similar to the profile of the outlet side 54 of the ramps 46 in the stator 14. The magnets 82 can cooperate with magnets embedded in the radial inner most side 31 of the gates 18 to produce a force of repulsion acting to lift the gates 18 from the stator 14*a*. This of course is equivalent to causing the gates 18 to move in the radial direction in the slots 22 toward the corresponding cavities 28.

With particular reference to FIG. 1, it can be seen that the gates 18 are formed with tapered transverse sides 86. The transverse sides 86 extend between the radially inner most side 31 and radially outer most side 27 of each gate 18. The transverse sides 86 are tapered in a direction so that the radially outer most side 27 has a greater length than the radially inner most side 31. To accommodate the tapered transverse sides 86, respective end plates 57 of the rotor 12 are formed with tapered or sloping channels 88. By appropriate dimensioning of the rotor 12 and the gates 18, the gates 18 may be provided with lateral clearance so that they are able to float or move to some extent in the axial direction within their corresponding slots 22. This enables the gates 18 to be positioned within their slots 22 so that the transverse sides 86 do not contact the channels 88 until the gates are in their fully extended position. The magnetic gate control system may also be arranged to urge the gates 18 to axially position themselves within their slots 22 so that there is no until the gates are in their fully extended position. In one example this may be achieved by embedding mutually repelling magnets along the transverse sides 86 and the channels 88. Thus the gate 18 is floated in a magnetic field in the axial direction. Of course the same effect can be achieved by providing mutually attracting magnets along the sides 86 and channels 88 of the same strength on either side. In this arrangement the gate 18 is pulled with equal force toward each of the end plates 57 and thus held in an intermediate location where the sides 86 are spaced from the channels 88.

It will be appreciated by those skilled in the art that the magnetic gate control system can be realised by way of numerous different configurations of magnets and the provision of ferromagnetic materials for various components. For example in a substantially complimentary version of the magnetic gate control system depicted with reference to the stator 14 in FIG. 3, the stator 14 can be made from a ferromagnetic material and while the gates 18 are provided with magnets which operate to exert a force biasing the gates 18 toward the hub 38. Further in this embodiment magnets may be embedded in the lobes 46 adjacent their outlets 54 of an opposite pole to repel the gates 18 so that they lift from that side of the lobes 46 as the rotor 12 rotates about the stator 14.

As previously described, in the machine 10, the number of gates 18 is not an integer multiple of the number of lobes 46. This may be expressed mathematically by the following:

Assume that there are M gates and N lobes where both M and N are integers>1. Then: (1) M>N (i.e. there are more gates than lobes); and (2) M/N is a non-integer>1. It is believed that providing the machine 10 with this relative number of lobes and gates provides several advantages over machines where the number of gates is an even multiple of the number of lobes. These include smoother operation, and the ability to reduce the reciprocating speed of the gates within their slots 22 particularly during a retraction phase where the gates are retracted to a maximum extent into their slots 22.

Figure 3:
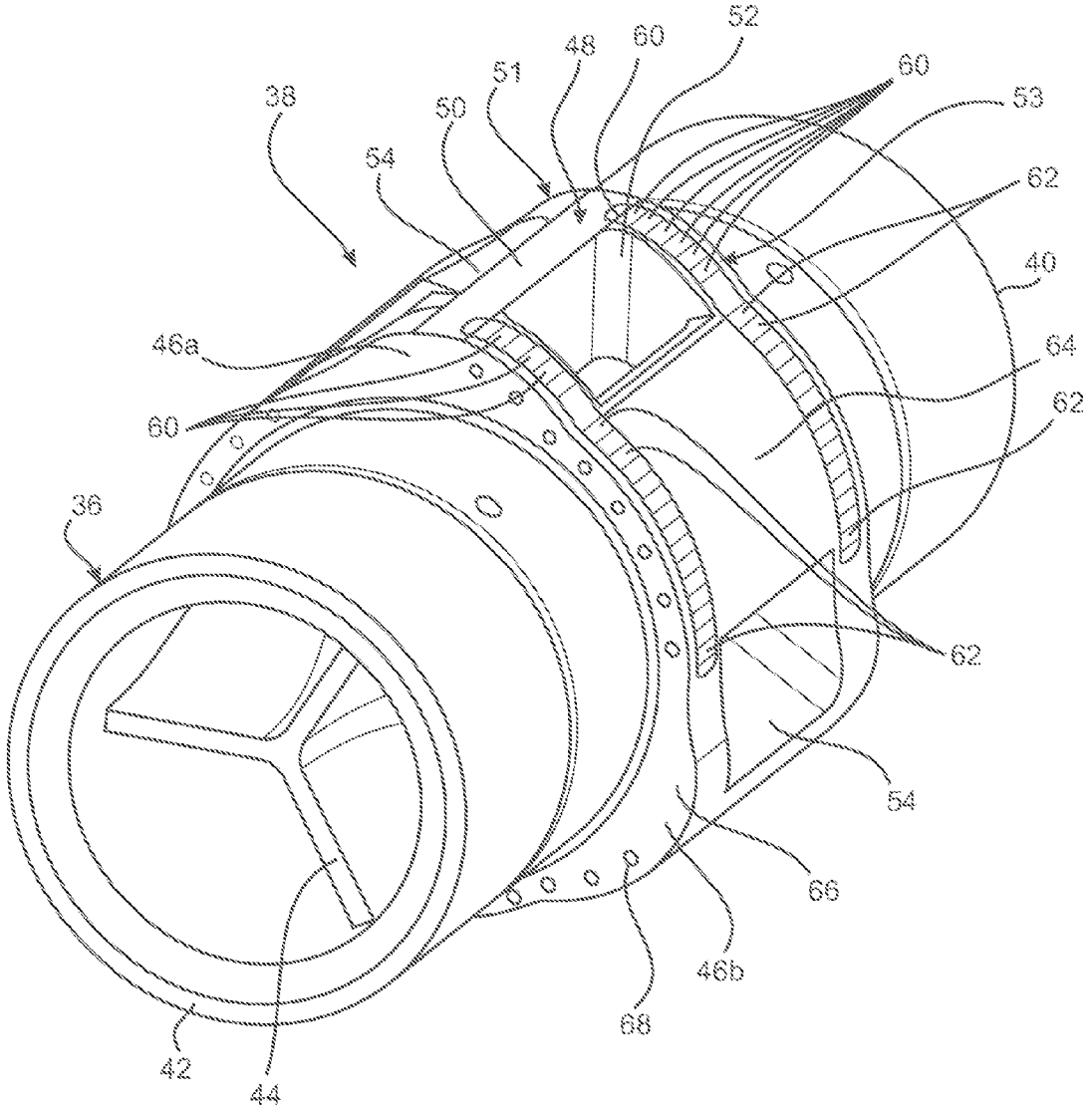
FIG. 3 is an isometric view of the stator incorporated in the machine shown in FIGS. 1 and 2.
Figures 7A, 7B:
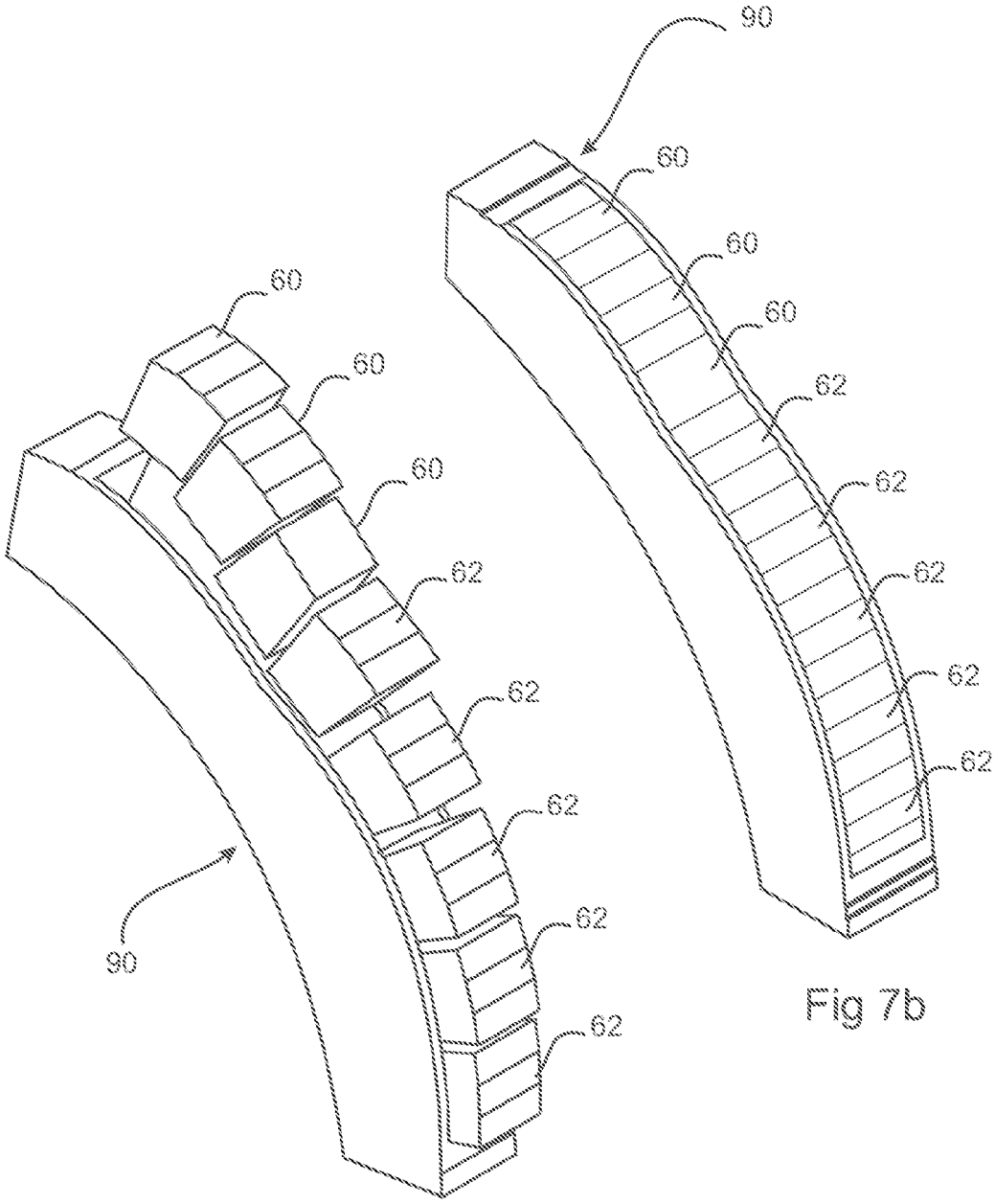
FIG. 7*a* is an exploded view of a magnet cartridge that may be incorporated in embodiments of the machine.
FIG. 7*b* is a view of the magnet cartridge shown in FIG. 7*a* but in an assembled condition.

In the embodiment depicted in FIG. 3, the magnets 60 and 62 are embedded within a channel or groove formed within the hub 38. However FIGS. 7*a* and 7*b* depict an alternate mechanism for mounting the magnets 60, 62 on the hub 38. In these embodiments, the individual magnets 60 and 62 are themselves retained within a cartridge 90 that can be detachably mounted within respective channel or groove formed in the hub 38. This facilitates a quick and relatively easy replacement of the magnets 60, 62 in the event that this may be required due to wear or some other problem in relation to the magnets 60, 62. FIGS. 7*a* and 7*b* also depict the configuration of the magnets 60, 62 and specifically show that the individual magnets are of varying shape and configuration in order to be in serial face to face contact. This arrangement is significant when the magnets 60, 62 are arranged in a Halbach array.

Figure 8:
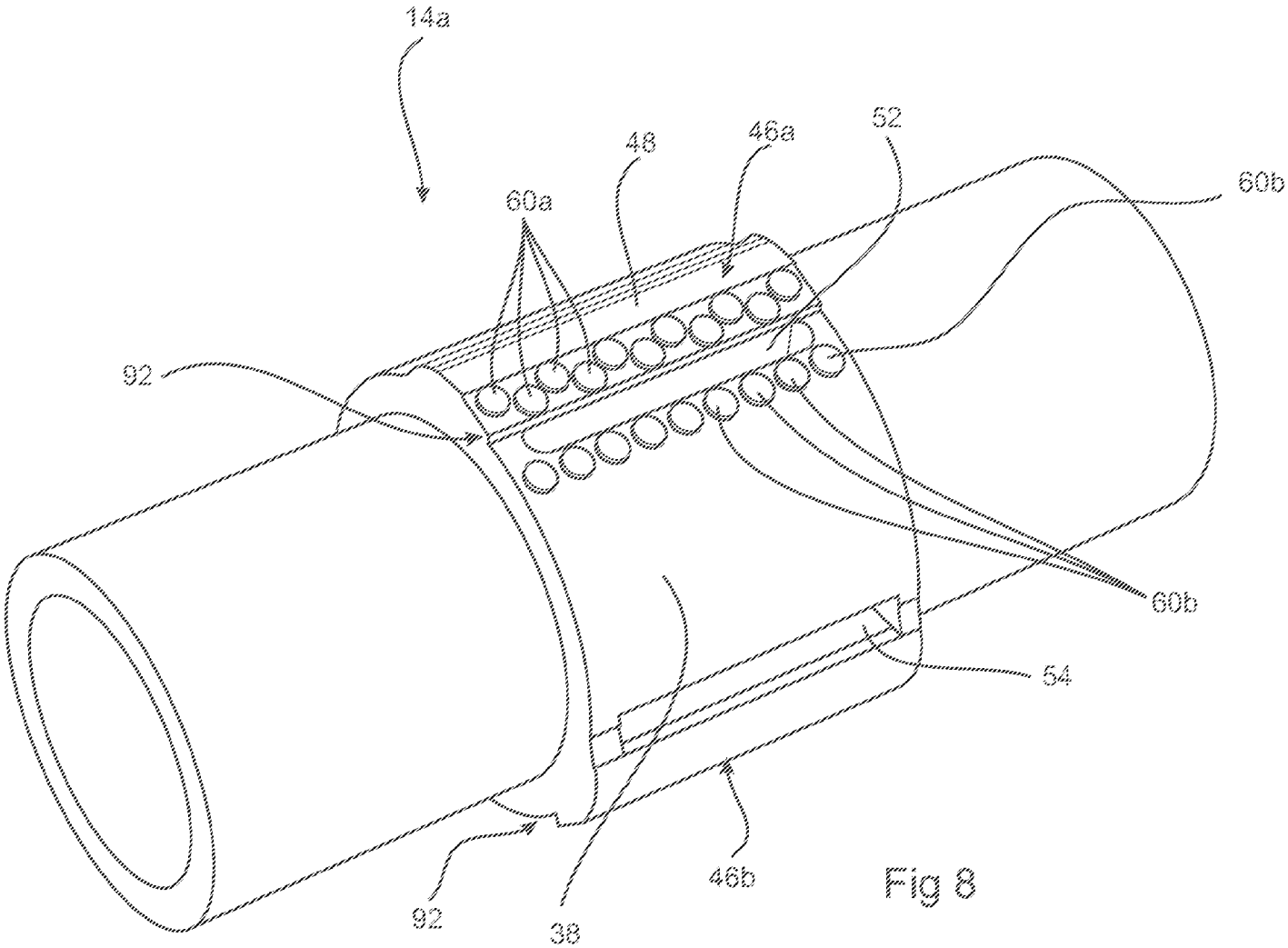
FIG. 8 is an isometric view of an alternate form of the stator that may be incorporated in a third embodiment of the machine.

FIG. 8 depicts a stator 14*a* which may be incorporated in a further embodiment of the machine 10. The stator 14*a* differs from the stator 14 depicted in for example FIG. 3 primarily by way of the arrangement of the magnets 60 and the shape and configuration of the lobes 46. In the stator 14*a*, the magnets 60 are arranged as first and second sets of magnets 60*a* and 60*b* disposed in an axial direction along opposite sides of the inlet/suction port 52. The magnets 60*a* of the first set are arranged in a staggered fashion on a side of the port 52 adjacent the crest 48 of lobe 46*a*. The magnets 60*b* in the second set of magnets are provided in a line on an opposite side of the port 52. The magnets 60*a* and 60*b* act on a gate (not shown) in a manner so as to attract the gate toward the magnets 60*b* and thus the surface of the hub 38. It will also be noted that there is not a continuous array circumferential array of magnets extending from the slot 52 to the next slot 54 on the constant diameter portion of the hub 38.

To place the stator 14*a* in context, in a corresponding machine when operated as a pump, the rotor would be turning in a clockwise direction so that a gate adjacent or on the crest 48 will rotate in a direction toward the visible inlet/suction port 52 of load 46*a* and the outlet/high pressure port 54 of lobe 46*b*. If desired, the magnets 60*a*, 60*b* can be arranged to provide magnetic fields of different strength. In particular the magnet 60*a* may provide a stronger or higher intensity magnetic field than the magnet 60*b* so as to accelerate a gate more quickly toward the surface of the hub 38.

A further aspect of differentiation between the stator 14*a* and stator 14 is the provision of a step 92 in the profile of the hub 38 adjacent the inlet port 52 on a side containing the magnets 60*a* (i.e. on a side nearest the corresponding crest 48). The step 92 extends for the axial length of the hub 38 adjacent each of the lobes 46. The step 92 forms a small circumferential transition zone where a gate moves between opposite sides of the inlet port 52 and has a greater clearance with the hub 38 to avoid and minimise the risk of impact and thereby assist in reducing wear.

Figure 9:
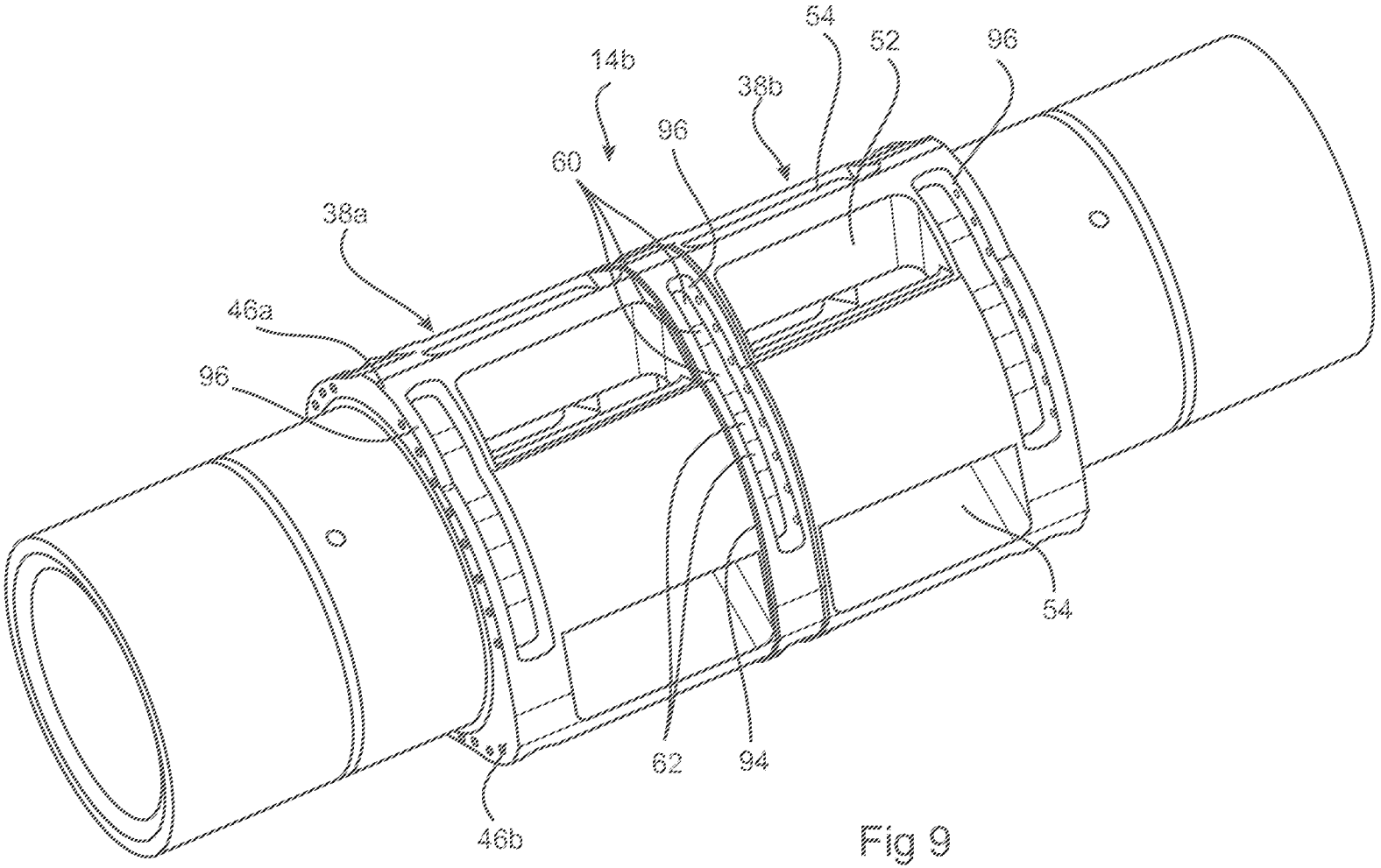
FIG. 9 is an isometric view of a stator incorporated in a fourth embodiment of the machine.

FIG. 9 depicts a further aspect of a stator 14*b* that may be incorporated in yet a further embodiment of the machine 10. The stator 14*b* is of a generally similar configuration to the rotor 14 depicted in FIG. 3 but is of an extended axial length. The extended axial length is realised by the provision of a hub 38*a* that in effect can be considered as two hubs 38 arranged back to back. Thus the hub 38*a* has three lobes (only lobes 46*a* and 46*b* being visible). A web or bridge 94 is formed between and is common to the adjacent hubs 38. The bridge 94 is provided with a slot 96 for seating magnets 60 and 62. Similar slots 96 are formed at axially opposite ends of the hub 38*a* for seating similar magnets 60 and 62. Inlet ports 52 and outlet ports 54 are formed on either side of each of the lobes 46. The ports may be considered as being provided in adjacent axially aligned pairs. For example with reference to the lobe 46*a*, a pair of axially aligned inlet/suction ports 52 is formed on one side of the lobe; while a pair of axially aligned outlet/high pressure ports 54 is formed on the other side. The respective pairs are separated by the bridge 94 that extends about the entire circumference of the hub 38*a*.

The stator 14*b* is provided as an example only of the ability to increase the capacity of the machine 10 by extending the machine 10 in the axial direction without increasing diameter. Naturally in the event that the stator 14 is extended in the axial direction by extending the axial extent of the hub 38*a*, then the rotor 12 needs to be extended in a commensurate manner. This may be done by extending the cylindrical ring 55 of the rotor 12 in axial direction to match the axial extent of the hub 38*a*, and fitting respective gates 18 which have also been extended in the axial direction in an identical manner.

In a further embodiment (described later) the stator 14 can be made in a manner in which the lobes 46 are formed separately from the remainder of the hub 38. In particular, the hub 38 can be made initially with a constant radius and then subsequently machined to form seats for receiving separately manufactured lobes. The lobes due to their complex shape can be either made by casting and then subjected to appropriate surface finishing such as grinding and polishing; or alternately separately machined. In both instances, the separately manufactured lobes can then be attached into the seats formed in the hub 38 of the stator. This manufacturing technique also enables the possibility of simply changing the lobes in the event of damage to them or their associated magnets or for the purposes of changing the magnets to provide either lower or higher intensity magnetic fields.

It will be noted that each of the stators 14, 14*a* and 14*b* (referred to in general as "stator 14" in the singular and "stators 14" in the plural) described to date are asymmetrical in configuration and that accordingly the machine 10 when made with the asymmetrical stators will rotate in one direction only. This follows from the need to change the direction of movement of a gate on opposite sides of a lobe. For example only the side of the lobe provided with an inlet port 52, the gate 18 is attracted by the associated magnets toward the hub 38. However on an opposite side of the same lobe the gate is moving in an upward direction away from a central axis of the hub 38. Accordingly one would either have no magnets on the outlet port side of a lobe 46 or indeed may have magnets which are arranged with a magnetic field in a direction so as to repel the gates 18.

However in an alternate embodiment the machine 10 can be made to operate in a bi-directional manner by profiling each lobe 46 to have a symmetrical curve about its crest 48, and providing electromagnets on either side of each lobe 46. It will be understood by those skilled in the art that by simply changing the direction of current for the electro magnets, the direction of the magnetic field can be changed. As the stator is by definition stationary, providing conductors in the body of the stator 14 to drive the electro magnets is from an engineering perspective, easily achievable. For example, grooves may be formed in the stator 14 to seat conductors and the grooves later filled with an epoxy or other encapsulating materials; or alternately passages can be formed in the stator 14 to receive the conductors.

Figure 10:
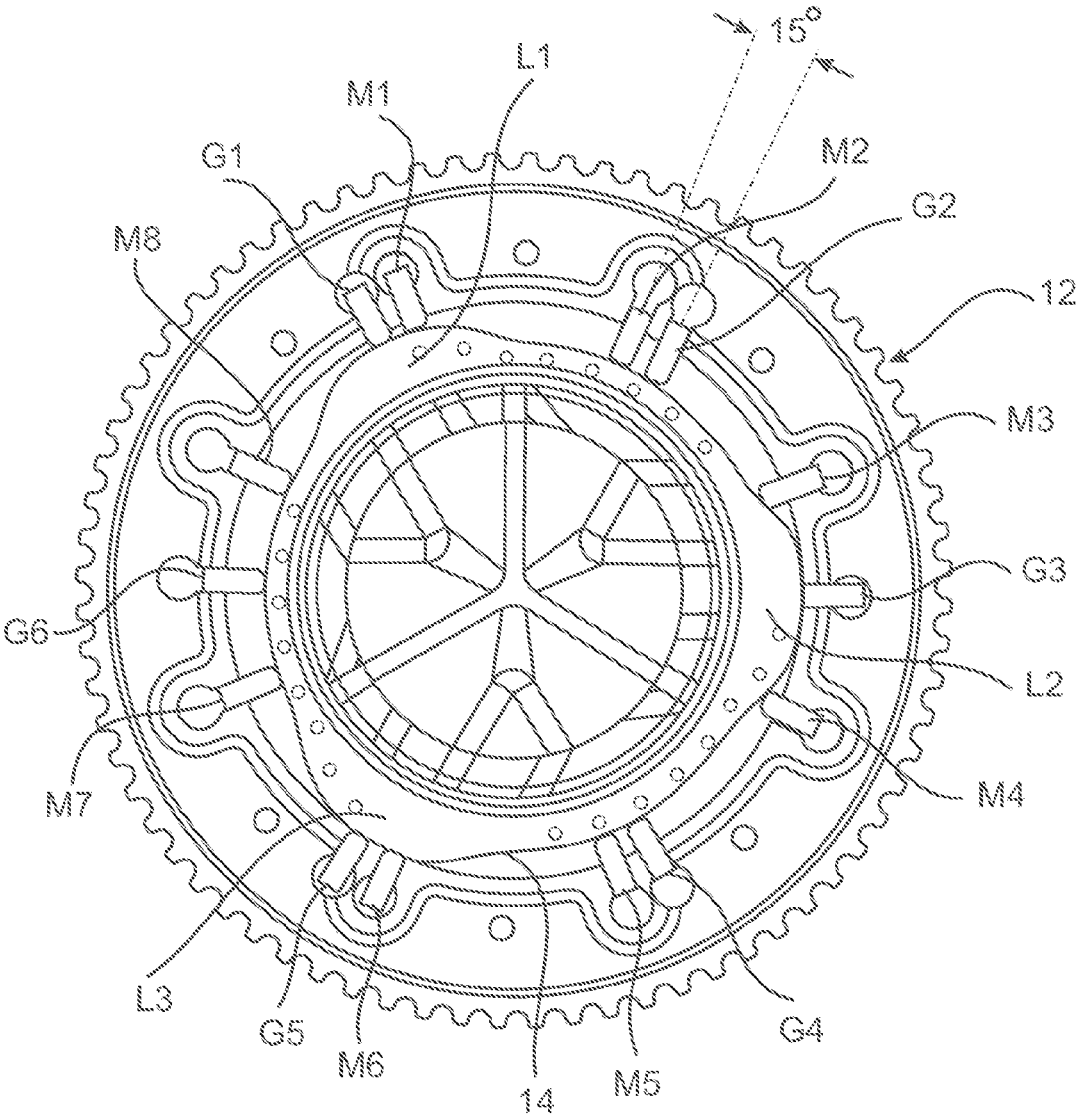
FIG. 10 provides is a visual comparison between an embodiment of the machine and a prior art machine.

FIG. 10 depicts relative positions of gates and lobes of two machines of the same diameter. The position of the lobes L1, L2 and L3 on a stator 14 is the same for both machines. One machine has six gates G1-G6 (referred to in general as "gates G") while another machine has eight gates M1-M8 (referred to in general as "gates M"). The angular spacing between the lobes L1, L2 and L3 is 120°. The angular spacing between the gates G is 60°, while the angular spacing between the gates M is 45°. The relative positions of these gate is depicted with reference to a fictitious common rotor 12.

Firstly consider the machine comprising the gates G. Assuming the rotor 12 is rotating in a clockwise direction, a sector of the working fluid space between the gates G1 and G2 will be filled with a slug of liquid flowing in via an inlet adjacent the lobe L1. Liquid in front of the gate G2 is in communication with the output port adjacent the lobe L2 and is thus being exhausted from the working fluid space. The maximum arc length of the working fluid space 16 that can contain a slug of fluid between adjacent gates (for example gates G1 and G2) and that is not in communication with an outlet port is of course 60°. When gate G1 is adjacent lobe L1 the maximum arc length exists and the gate G2 is midway between the lobes L1 and L2. From here, the gate G2 has a further 60° of rotation until being lifted or retracted to its maximum extent by the lobe L2.

In comparison for the machine comprising the gates M the maximum arc length of working fluid held between two adjacent gates M spans a 45°. Depending on the width of the inlet and outlet ports in the direction of rotation it is possible for two sets of adjacent gates to hold slugs of fluid between adjacent lobes L and isolated from an outlet port. For example fluid can be contained between both M1 and M2, and M2 and M3 simultaneously before fluid between M2 and M3 reaches the outlet port of lobe L2. Thus the maximum arc length of working fluid held between the gates M can span 90°.

In the present example in the event that gates G1 and M1 are at the same location at the top of lobe L1, then the gate M2 will be 15° behind the gate G2. Thus the gate M2 requires to be rotated by 15° further than the gate G2 to reach its fully retracted position where it lies directly opposite the crest of lobe L2. Assuming the same rotational speed of the rotor 12, this additional 15° enables the gate M2 to be lifted at a slower rate than the gate G2. That is, the gate M2 has more time to reciprocate within its slot than the gate G2. This relative slowing of the reciprocating motion of the gates M provides benefits in terms of allowing more time for the activation of the gates from fully retracted to fully extended, reducing wear, noise, vibration and stress on the machine 10.

It will be appreciated by those skilled in the art that benefits of this relationship between the number of gates and lobes are not limited to arrangements where machines are provided with a magnetic gate control system. The benefits will apply equally to machines having traditional mechanical gate control systems. Indeed the benefits may be amplified in such machines as this further reduces stress and wear on the mechanical components used to control the motion of the gates.

Whilst a number of specific embodiments of the machine have been described, it should be appreciated that the machine and associated method of operation may be embodied in many other forms. Examples of these other embodiments and other modifications and variations to various features of the machine and method will now be described in some detail.

In the previous embodiments of the machine 10 the magnetic gate control system comprises a plurality of magnets 60 embedded in the lobes 46 and extending on the descending side 53 from the crest 48 to the constant diameter portion 64. These magnets may be arranged in a Halbach array and optionally held within cartridges 90 shown in FIGS. 7*a* and 7*b*. However in an alternate embodiment the plurality of magnets 60 at each axial end of a lobe 46 may be replaced with a respective single magnet that is configured to produce a magnetic field that may be constant or varies in the direction of relative rotation between the bodies 12 and 14. In particular the single magnet may be shaped and/or magnetised so as to provide the highest magnetic field adjacent or near the crest 48 with a progressively diminishing magnetic field at an end adjacent the constant diameter portion 64. This is explained with reference to the magnet 60*v* depicted in FIGS. 11 and 12.

Figure 11:
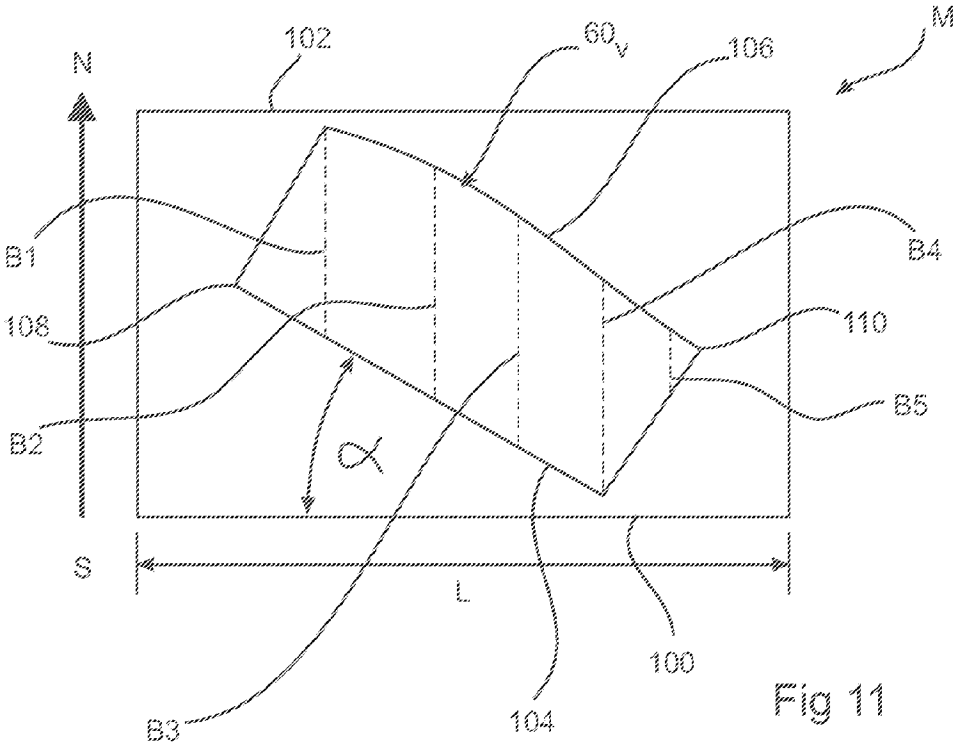
FIG. 11 is a schematic representation of a construction technique for a magnet incorporated in a magnetic gate control system of a fifth embodiment of the machine.

FIG. 11 depicts in side view, a rectangular prism shaped magnet M. The magnet M has a uniform magnetic field along its length L with a south pole formed on a lower side 100 and a north pole on an upper side 102. The magnet 60*v* is formed by cutting it from the block magnet M in a specific orientation and shape. The field strength of the block magnet M (and indeed any magnet) is dependent on the path length of the material of the magnet in the direction of the magnetic field. As the block magnet M is in the shape of a regular rectangular prism the length of material in the direction of the magnetic field is constant. Thus the magnet M has a substantially constant magnetic field along its length L.

Consider now the magnet 60*v* which is cut from the magnet M in a shape having a planar base 104 that extends at an angle $\alpha$ to the surface 100 of the magnet M and has an opposite face 106 that is profiled to have a shape substantially matching that of the descending side 53 of the lobe 46. The angle $\alpha$ may be between 0°-90° but in one particular embodiment a is in the order of 10°-40° and any sub range with that range, for example 20°-30°. Phantom lines B1-B4 drawn in the magnet 60*v* lie in a direction parallel to the direction of the magnetic field from south to north in the magnet M from which the magnet 60*v* is cut. The line B2 is the longest length. The line B3 is the second longest line, lines B1 and B4 are of the same length and line B5 is the shortest length. These lengths correspond with the magnetic field strength in the magnet 60*v* in planes containing the line B1-B5.

In addition to profiling the face 106, the magnetic field characteristics may also be controlled by: profiling the face 104 so that it is not necessarily planar; and by varying the thickness magnet 60*v*. Further other techniques and manufacturing processes may be used to produce magnets having predetermined magnetic fields. For example magnets with desired magnetic fields may be made from metal powders using liquid phase sintering.

Figure 12:
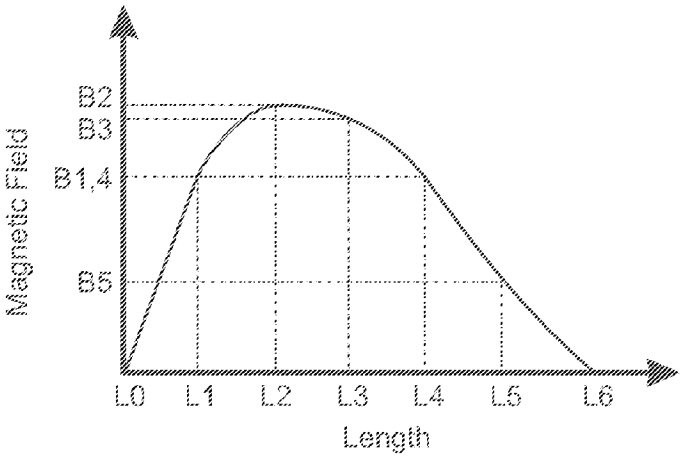
FIG. 12 is a graphical representation of magnetic field strength of the magnet shown in FIG. 11.

The magnetic field strength is plotted in FIG. 12 from a corner 108 at an upper end of the side 104 of magnet 60*v* to a corner 110 at a lower end of the side 106. The lengths at the corners 108 and 110 are in essence zero and are represented in FIG. 12 as lengths Lo and L6 respective. From this it will be seen that the field strength of the magnet 60*v* varies in the direction of its length. This enables control of the magnetic field strength in the machine 10 so that a relatively high magnetic field strength is presented to a gate near or adjacent a crest 48 of a lobe 46 with the field strength diminishing to a minimum at or near the constant diameter portion 64. This coincides with the desire to control the motion of the gate 18 to be positioned so as to form a substantial seal at the time it is radially aligned with the commencement of the constant diameter portion 64. One possible acceleration profile to achieve this to provide a relatively rapid acceleration of the gate in the direction of extension for an initial time period after the gate passes the crest 48 but with reduced acceleration as the gate approaches the constant diameter portion 64. This may avoid or will at least minimise impact or indeed any contact with the constant diameter portion 64. As previously mentioned, direct contact may not be required between a gate 18 and the surface 64. What is required is close positioning so as to form a substantial seal there between.

The gate 60*v* can be embedded in the stator 14 so that the corner 108 is positioned in radial alignment with the midpoint of the crest 46, or indeed closer to the leading side 55 of the corresponding lobe. This is represented in phantom line in FIG. 4.

Figure 13:
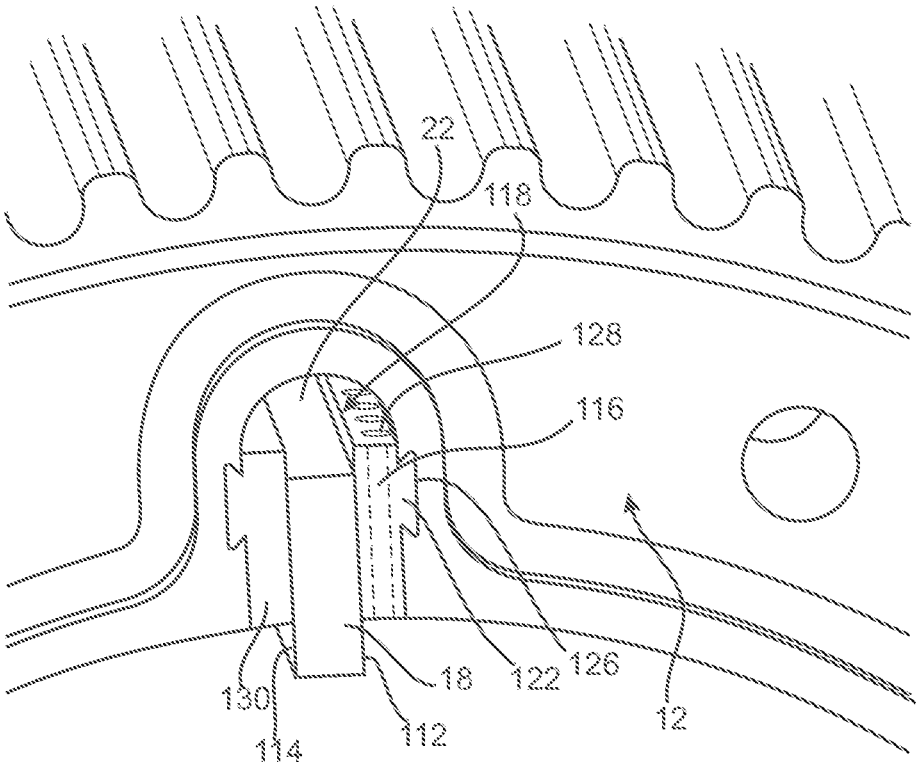
FIG. 13 illustrates one arrangement for a bleed system that may be incorporated in embodiments of the machine.
Figure 14:
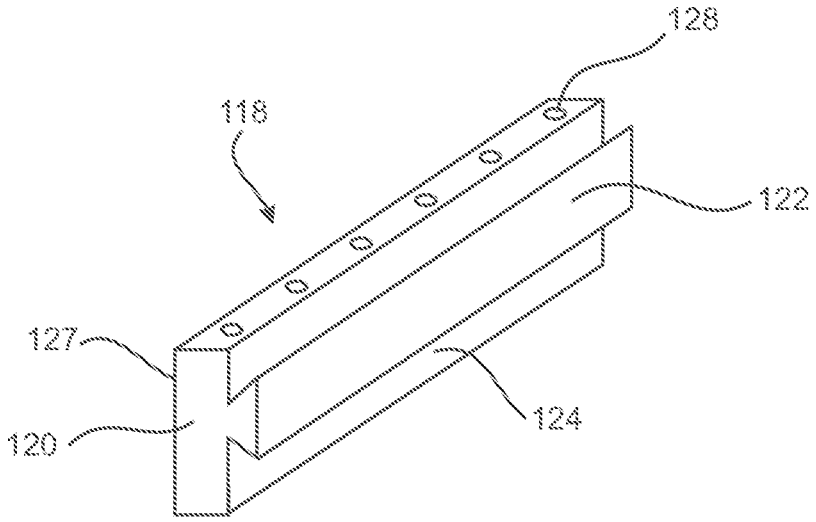
FIG. 14 is a schematic representation of an insert configured to form part of the bleed system shown in FIG. 13.

FIGS. 13 and 14 depict further variations in the machine 10 which relate to the motion of the gates 18 and in particular the avoidance of hydraulic lock when a gate 18 is retracting into its corresponding slot 22 in the body 12. With particular reference to FIG. 13, assuming that the body 12 is rotating in the clockwise direction then a right hand side of the gate 18 constitutes a leading face 112, while the left hand side constitutes a trailing face 114. As the body 12 rotates and the gate 18 approaches a lobe 46, the gate 18 is retracted into its slots 22. The slot 22 is likely to contain a volume of the working fluid that flows through the machine 10. While working fluid remains in the slot 22, there is a possibility of a hydraulic lock occurring in which the fluid is pressurised by the retracting gate 18 and thereby resists the retraction of the gate 18 into the slot 22. If the gate 18 does not fully retract when aligned with a lobe crest excessive wear will occur with a possibility of jamming of the machine 10. To minimise the risk of this occurring, a bleed path 116 is formed between the gate 18 and a facing side of the slot 22. In this particular embodiment, the bleed path 116 is formed between the leading face 112 of the gate 18 and an insert 118 that is fitted into the body 12 to constitute a portion of the slot 22. The insert 118 is in the form of a strip of material 120 provided with a dove tail tongue 122 extending along the length of a leading face 124. The dove tail tongue 122 engages with a complimentarily shaped dove tail slot 126 formed in the body 12. A trailing face 127 of the insert 118 is planar and may be polished to provide minimal friction. The bleed path 116 is constituted by a plurality of radially extending holes 128 formed in the strip 118 between and internal of the faces 124 and 126.

While the bleed paths 116 in the embodiment shown in FIGS. 13 and 14 are created by holes 128 formed internally of the strip 118, in a variation, similar bleed paths 116 may be formed by providing channels in the face 126 of the strip 118; or indeed channels in the leading face 122 of the gate 18. Optionally, a spacer strip 130 may be provided in the slot 22 on a side opposite the strip 118. The spacer strip 130 is formed with a planar leading face 132 that in use forms a bearing surface for the gate 18 as it reciprocates within the slot 22. No bleed paths are provided in or on the spacer slot 130. One effect of the provision of the strip 118 and enhanced by the provision of the basis strip 130 is the narrowing of the slot 22 and a commensurate narrowing in the thickness of the gate 18. As a consequence of this, the gates 18 in embodiments incorporating the strips 118 and/or 130 can be made thinner than gates in comparable machines which do not incorporate such strips but have slots 22 of the same width as the current slots.

Reduction in the weight or mass of the gate 18 has substantial benefits in terms of enabling the gate 18 to move between its fully retracted and fully extended positions within the time frame provided by the passing of a lobe 46. A gate 18 is required to move from its fully retracted position to its fully extended position by the time the relative positions between the bodies 12 and 14 move from one where the middle of the crest 48 is directly below the gate 18 to when the immediately adjacent constant diameter portion 64 is radially aligned with the gate 18. Depending on the diameter of the bodies 12 and 14 and the rotational speed this time frame may be in the order of several to several tens of .milliseconds. To provide context for a machine rotating at about 600 rpm and with an outer diameter of about 20 cm the time taken for a gate 18 to move from its fully retracted position to its fully extended position may be about 5 ms-20 ms. It will be appreciated that not only is the mass of the gate 18 relevant to accelerating the gate toward the retracted position it is also relevant in terms of reducing the centrifugal force acting on the gate 18 which tends to urge the gate 18 away from the retracted position.

Figure 15:
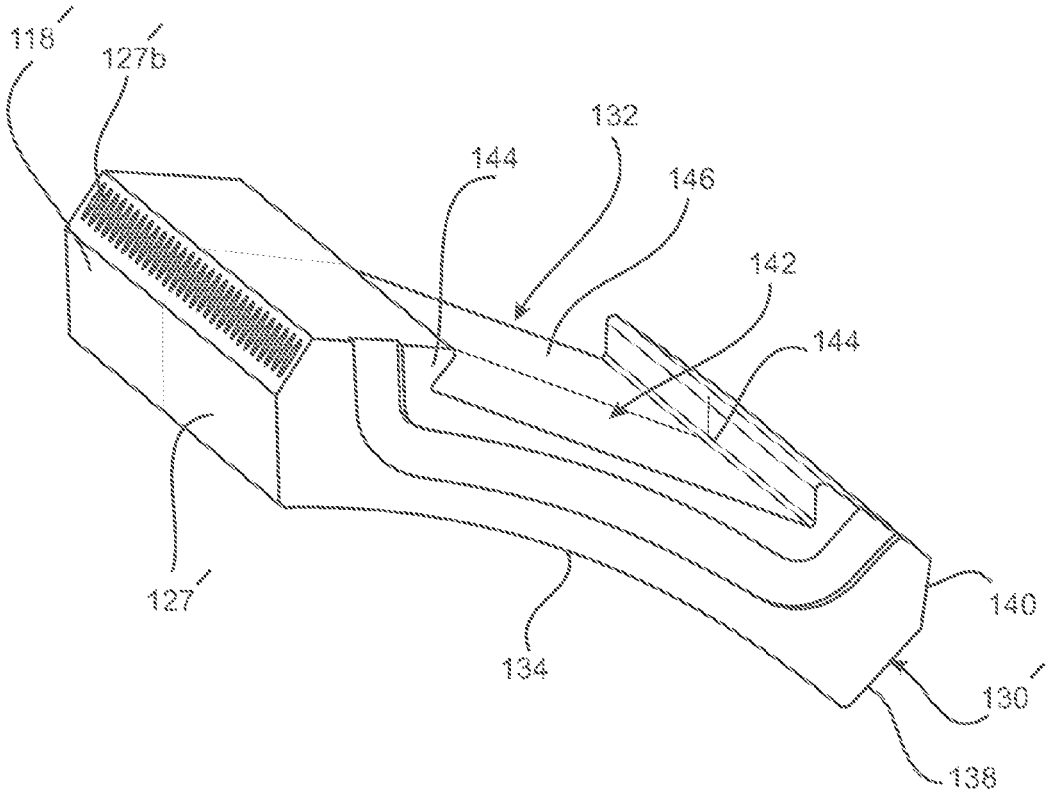
FIG. 15 is a schematic representation of a portion of a rotor incorporated in a sixth embodiment of the machine.
Figure 16:
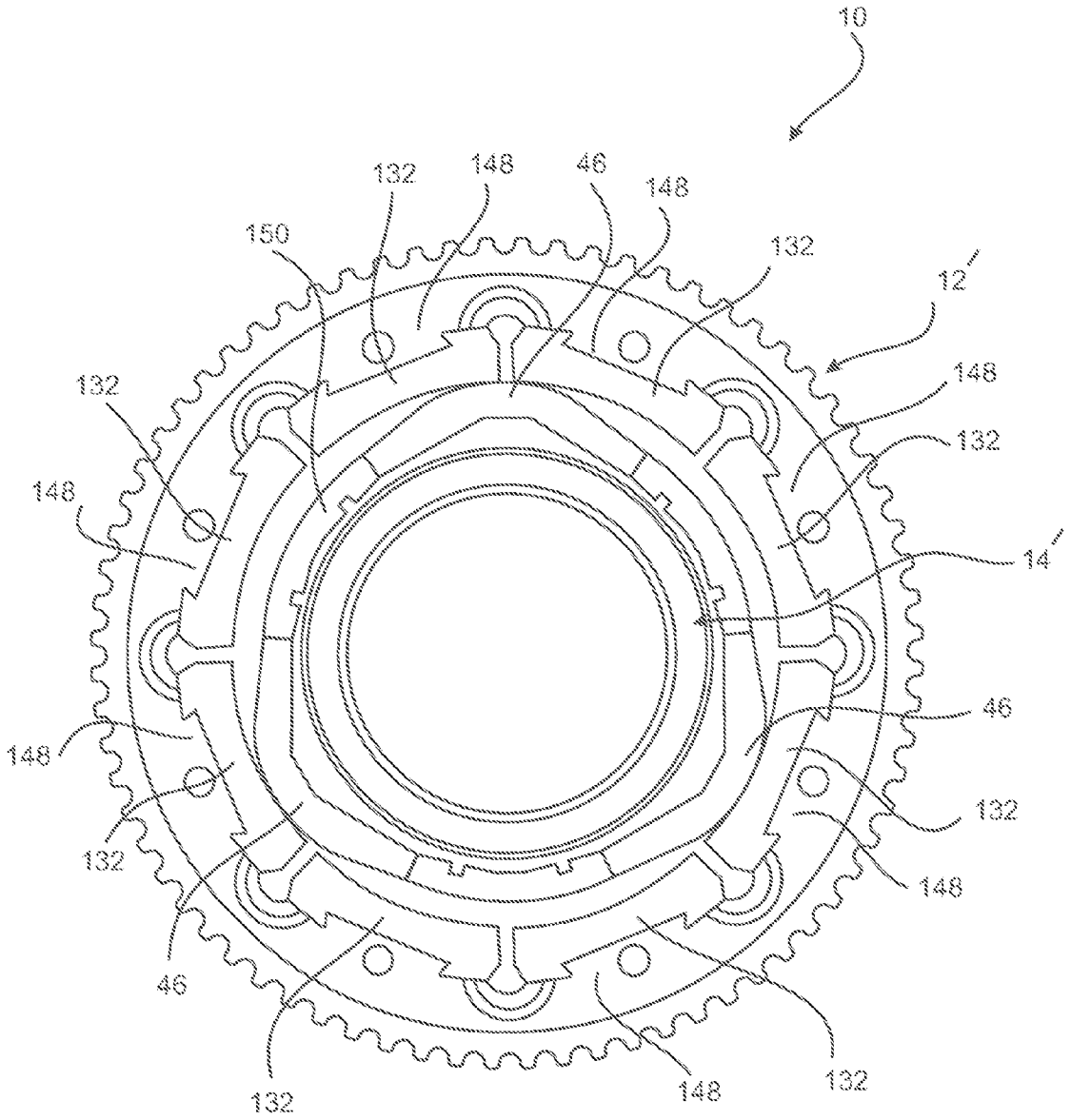
FIG. 16 is an end schematic representation of an embodiment of the machine depicting a rotor and stator with demountably coupled replaceable and separately made lining components.

FIG. 15 depicts a modification or enhancement of the bleed system shown in FIGS. 13 and 14 by merging the functionality of the strips 118 and 130 in a common lining block 132. The lining block 132 in effect incorporates both a strip 118 and a spacer strip 130 but for adjacent slots 22 rather than for the same slot 22. The lining block 132 has an inner radial circumferential surface 134. As shown in FIG. 16 a plurality of lining blocks 132 can be mounted side by side so as together form the inner circumferential surface of the body 12'.

The block 132 has one end 118' that is shaped and configured to perform the same function as the strip 118 in the embodiment shown in FIGS. 13 and 14. The end 118' however is of a slightly different configuration to the strip 118. End 118' has a trailing face 127' that includes a portion 127' extending in the radial direction and a contiguous inclined portion 127'*b* at an upper radial end. Bleed holes 128' open onto the bevelled surface 136 and extend in a radial direction through the block 132 to open at an opposite end onto inner circumferential surface 134. The end 130 is formed with a planar surface 138 that extends in a radial direction, and a contiguous inclined surface 140. As shown most clearly in FIG. 16, the surfaces 127'*b* and 140 are relatively inclined so as to form a funnel like throat in the slot 22 that narrows in the radial direction from the body 12' toward the axis of rotation. The radial distant side 142 of the block 132 is formed with opposite shoulders 144 that are inclined toward each other and together form a dovetail slot 146 for slidingly engaging a corresponding dovetail tongue 148 formed between adjacent slots 22.

As shown in FIG. 16, and previously described, a plurality of the blocks 132 is incorporated in the body 12' to form the entirety of its inner circumferential surface. In such an embodiment the first body 12' may have the construction of a first body super structure (in this embodiment in the form of a ring) onto which is detachably coupled the separately made first body lining blocks 132. The blocks 132 may be made from a different material to the remainder of the body 12'. In particular the blocks 132 may be made from for example plastics materials such as but not limited to: metal, metal alloys, ceramic materials, composite materials or plastics materials including polyetherketone (PEK) or polyetherther-ketone (PEEK). This has substantial benefits in terms of reducing the mass of the machine 10 and substantially increasing its service life by enabling easy replacement of the inner circumferential surface of the body 12' by simply replacing the blocks 132 if and when worn or otherwise damaged.

The second body 14' may similarly be provided with a plurality of blocks to form its outer circumferential surface. This is shown also in FIG. 16. As previously alluded to in the specification the lobes 46 may be made separately from the remainder of the hub 38. However in the embodiment shown in FIG. 16 not only are the lobes 46 made separately from the remainder of the hub but additionally separate lining blocks 150 are provided between adjacent lobes 46 to form the constant diameter surface portion 64 of the body 14'. Thus the second body 14' may have the construction of a second body super structure onto which is detachably coupled the separately made lobes 46 and the lining blocks 150. In a broad sense the separately made lobes 46 and the lining blocks 150 may be considered to be second body lining blocks.

It will be appreciated that the ability to construct the first and second bodies as respective super structures to which are coupled one or more respective and separately made lining block in independent of the gate motion control system. That is this construction may also be used with traditional mechanical gate control systems for example of cam type gate lifters.

Figure 17:
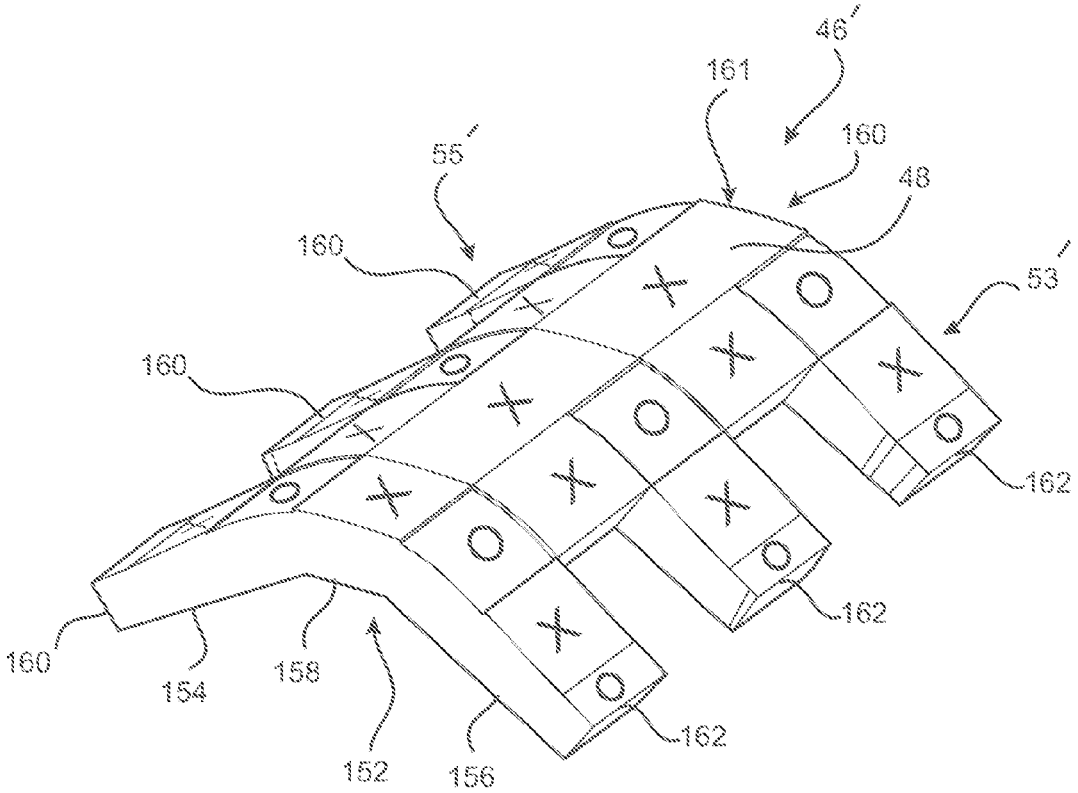
FIG. 17 is a schematic representation of a demountably coupled lobe incorporated in the embodiment of the machine depicted in FIG. 16.

FIG. 17 depicts in greater detail one possible configuration of a separately formed lobe designated here as lobe 46'. The lobe 46' is formed not only to enable easy replacement in the event of excessive wear, but also to equalise wear along the radial inner end 31 of the gates 18. The lobe 46' may be formed by any appropriate manufacturing process including for example moulding or casting with subsequent surface finishing; or alternately machining from a larger block of material. The manufacturing process is not of significance to the features and functionality of the lobe 46'. Further, as will be described in greater detail shortly, the ability of the lobe 46' to equalise wear along the inner radial end 31 of the gates 18 is a result of the structure and configuration of the lobe 46' and is totally independent of the ability of the lobe 46' to be replaceable. That is, the wear equalisation feature can be incorporated in a lobe 46 that is formed integrally with the hub 38 as will be explained shortly.

The lobe 46' has a radial inner side in the general shape of a truncated cone or triangle having opposed surfaces 154 and 156 that are inclined toward each other and lead to a contiguous bridging surface 158 that lies tangential to the radius of the machine 10. A radial outer side of the lobe 46' constitutes the lobe surface 161 and comprises the crest 48' as well as ascending and descending sides 51' and 53' respectively. The lobe 46' is configured so that surfaces of the ascending and descending sides 51' and 53' are constituted by a patch work of relatively raised surfaces denoted by the letter "X" and recessed surfaces denoted with the letter "O". The general idea here is to present the entirety of the length of the end 31 of each gate 18 with the same degree of contact with either the lobe 46' or bypass lamina flow of fluid and thereby provide conditions that may facilitate even wear along the end 31.

Prior to describing this further, reference is made to FIG. 3 to explain the typical wear pattern of the end 31 of a gate 18. A gate 18 in a body 14 rotating in a clockwise direction about the body 12/hub 38 will ride up the ascending side 51, across the crest 48, and down the descending side 53 of the lobe 46. The end 31 of the gate 18 may directly contact one or more of the sides 51, 53 and the crest 48. Alternately, or additionally for parts of the travel across the lobe 46 there may be a small gap between the end 31 and the surfaces of the lobe 46 through which a small lamina flow of fluid may occur. Depending on the nature of the fluid flowing through the machine 10 this fluid may cause abrasive wear. For simplicity however consider the situation where there is direct contact between the end 31 and the lobe 46. For each traverse of a lobe 46 the axial opposite sides of the end 31 are subjected to more wear than the intermediate portion of the end 31 that would overlie the inlet 52 and the outlet 54 simply because there is no material contact in these regions. This may lead to the development of a small lip on the intermediate portion of the end 31 between the axial opposite sides. This small lip may in turn result in excessive wear on the constant diameter portion 64, and also lead to increased gap between the axial opposite ends of the gate when traversing the constant diameter portion 64 thus leading to a reduction in pressure differential across the gate.

Returning back to the lobe 46' in FIG. 17, this issue of differential wear is sought to be avoided by structuring the lobe 46' so that for the totality of the travel of a gate across a lobe 46' the end 31 of the gate will be subjected to substantially uniform wear. This arises due to the relative disposition of the raised and recessed surfaces X and O on the ascending and descending sides 51' and 53' respectively. The lobe 46' may be considered as comprising three legs 160 on the ascending side 51' and three legs 162 on the descending side 53'. Considered now a gate approaching and subsequently riding up the legs 160 on the ascending side 51'. Again assuming direct contact, the portions of the gate directly beneath the raised surface portions X on the legs 160 are subjected to wear while the intermediate portions are not. As the gate traverses past the legs 160 onto the main body, the portions that were previously subjected to wear on the legs 160 now traverse the recessed surface portions O. Conversely the portions that were not subjected to any contact when riding along the legs 160 are now in contact with the raised surface portions X between the crest 48' and the legs 160.

The raised surface portions X on the ascending side 51' are arranged so that end 31 of the gate traversing from the lower end of the legs 160 up to the commencement of the crest 48 is subjected to substantially the same wear for the entirety of its length. Of course the gate when traversing the crest 48' is also subjected to uniform wear of the entirety of its length. On the trailing side 53' the raised surface portions X on the legs 162, and on the portion of the lobe 46' between the legs 162 and the crest 48' are arranged to again provide uniform wear for the gate 31 along the entirety of its length in a similar manner as described in relation to the ascending side 51'.

Clearly, the above arrangement of raised and recess surfaces X and O can be provided on a lobe that 46 formed integrally with the body 14/hub 38. Forming the lobe 46' separately however provides additional potential benefits in extending the service life of the machine 10 by allowing easy replacement of worn or damaged lobes. Further, the separate formation of the lobes 46' enables them to be made from different materials and different manufacturing processes that may assist in supplying manufacture and reducing manufacturing costs. The lobes 46' may be made from many materials suitable for the application at hand for the machine 10. Accordingly the lobes 46' may be made from materials including but not limited: metal, metal alloys, ceramic materials, composite materials or plastics materials including PEK and PEEK. In the event that the lobes 46' are made from a plastics material the magnets 60, **60*v* may be provided in recesses formed in the lobes 46' and hermetically sealed in the lobes 46'**.

Due to the independence of materials that may now be used in the manufacture of the machine 10, it is possible for example to form the lobes 46' with plastics material, while the gates 18 are formed from a metal which is hardened so as to further minimise wear.

Indeed the lobes 46', blocks 132 and 150, and/or gates 18 may be made for a wide range of materials such as metals, metal alloys, composites, and including parts made for one material and provided with a coating of another material to best suit the application at hand. In essence this construction of the machine 10 enables a mix and match of component parts made from materials that best suit the performance requirements for that part without the need to compromise for example on characteristic such as surface finish, hardness, weight, magnetic susceptibility, thermal conduction, pressure rating etc.

Figure 18:
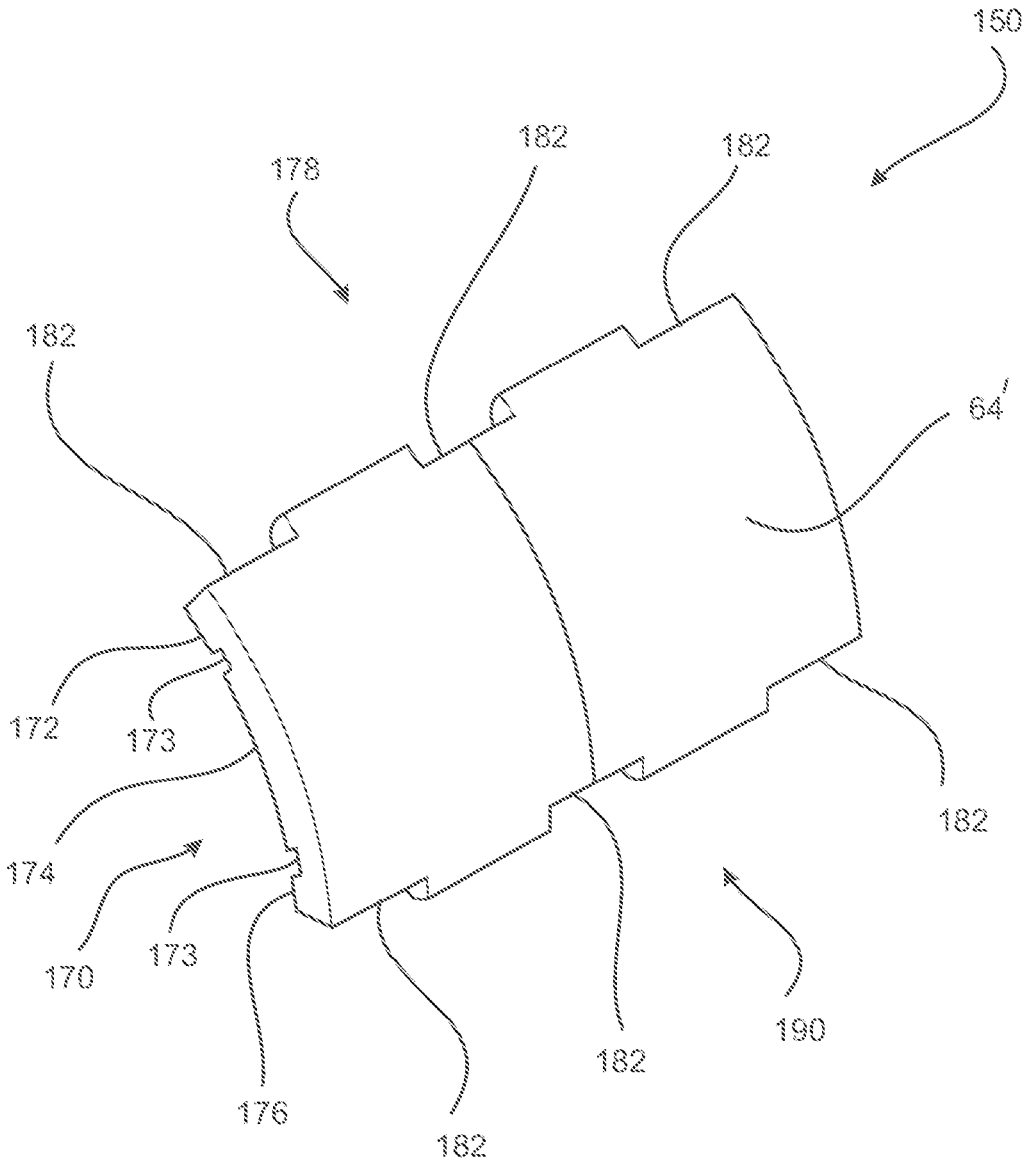
FIG. 18 is a schematic representation of a lining block incorporated in the embodiment of the machine shown in FIG. 16.

FIG. 18 depicts in perspective view an embodiment of a body 14' lining block 150. The lining block has a radial outer surface 64' which in the machine 10' of FIG. 16 constitutes a constant diameter portion of the body 14'. The surface 64' thus performs the same function and purpose as the constant diameter portion 64 of the hub 38 depicted in FIG. 3. A radial inner side 170 of the lining block 150 is composed of three contiguous planar surfaces 172, 174 and 176. These surfaces co-operate so that the side 170 is generally concave in configuration. The surfaces 172 and 176 are symmetrically inclined relative to each other on opposite sides of the surface 174. Optionally notches 173 are formed in the surfaces 172 and 174 to assist in coupling the lining blocks 150 to the body 14'.

Opposite axial sides 178 and 180 of the liners 150 are formed with a plurality of shallow castellations. The castellations are manifested by spaced apart recesses 182 along the sides 178 and 180. When the liners 150 are located on a body 14 and abut adjacent lobes 46', the recesses 182 will lie adjacent the feet 160 or 162. Providing the castellations avoids the creation of a straight edge in the axial direction between circumferentially adjacent lobes 46' and liners 150. In the absence of this there is the possibility straight edge to straight edge contact between the gates 18 and the junction of the lobes 46' and liners 150. Such contact can produce excessive wear in the form of a depression or recess leading to increased leakage and loss of efficiency.

Figure 19:
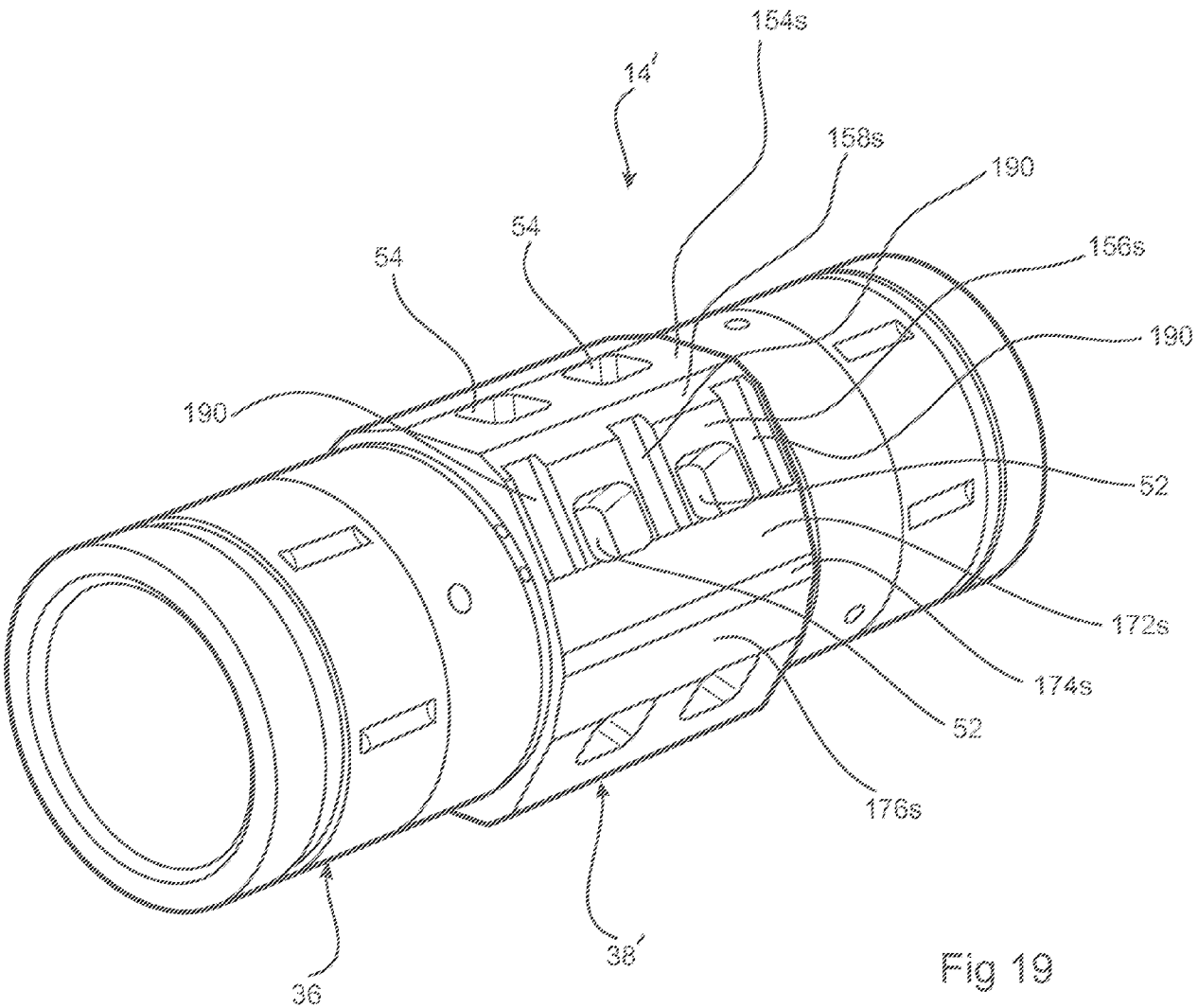
FIG. 19 is an isometric view of a super structure of a stator incorporated in a further embodiment of the machine; and, FIG. 20 is a partial isometric view of the embodiment of the machine shown in FIG. 16.

FIG. 19 depicts the super structure of the body 14' which is specifically configured to receive the demountable lobes 46' and the liners 150. The super structure of body 14' is formed with a conduit 36 identical to that of the body 14 but a modified hub 38'. The hub 38' is modified by the provision of plurality of contiguous planar faces that are configured in a manner complimentarily to the radial inner sides 152 and 170 of the lobes 46' and the liners 150 respectively. Specifically, the body 14' has a planar surface 158*s* extending in the axial direction between the inlet ports 52 and outlet ports 54. To the left hand side of surface 158*s* is a planar surface 154*s*. On the right hand side of the surface 158*s* is a further planar surface 156*s*. The planar surface 156*s* is provided with the inlet ports 52. The planar surface 156*s* is interrupted by three channels 190 that extend parallel to each other and in a generally circumferential direction. The channels 190 are formed with a planar base and upstanding sides. The purpose of the channels 190 is to receive or otherwise provide clearance for a radial inner portion of magnets 60*v* (shown in FIG. 11) that may be embedded at least partially within the legs 162 of the lobes 46'. Surfaces 154*s*, 158*s*, and 156*s* are designed to be in face to face contact with the surfaces 154, 158 and 156 respectively of the demountable lobes 46'.

The body 14' further comprises adjacent the surface 156*s*, a planar surface 172*s* which in turn leads to a planar surface 174*s* and subsequently to a contiguous surface 176*s*. Each of these surfaces 172*s*, 174*s*, and 176*s* extend in the axial direction of the hub 38'. These surfaces are configured to lie in face to face contact with the surfaces 172, 174 and 176 respectively of a liner block 150.

Figure 20:
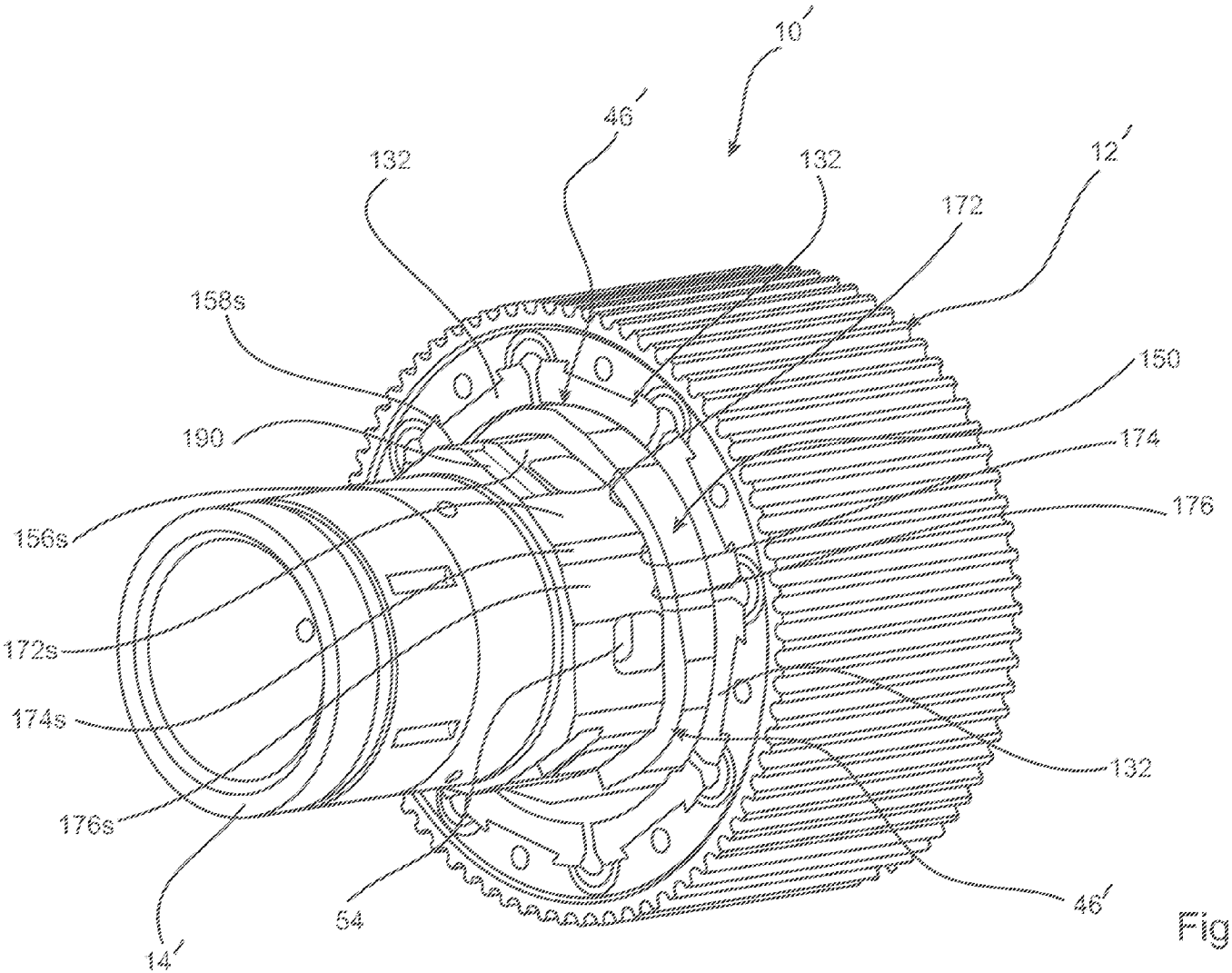

The body 14' has a plurality of sets of surfaces 154*s*, 158*s* and 156*s* for each demountable lobe 46; and one set of surfaces 172*s*, 174*s* and 176*s* for each of the liner blocks 150. A partial exploded view of the machine 10' constructed using the bodies 12' and 14', lining box 132, demountable lobes 46', and liners 150 as depicted is FIG. 20.

Figure 21:
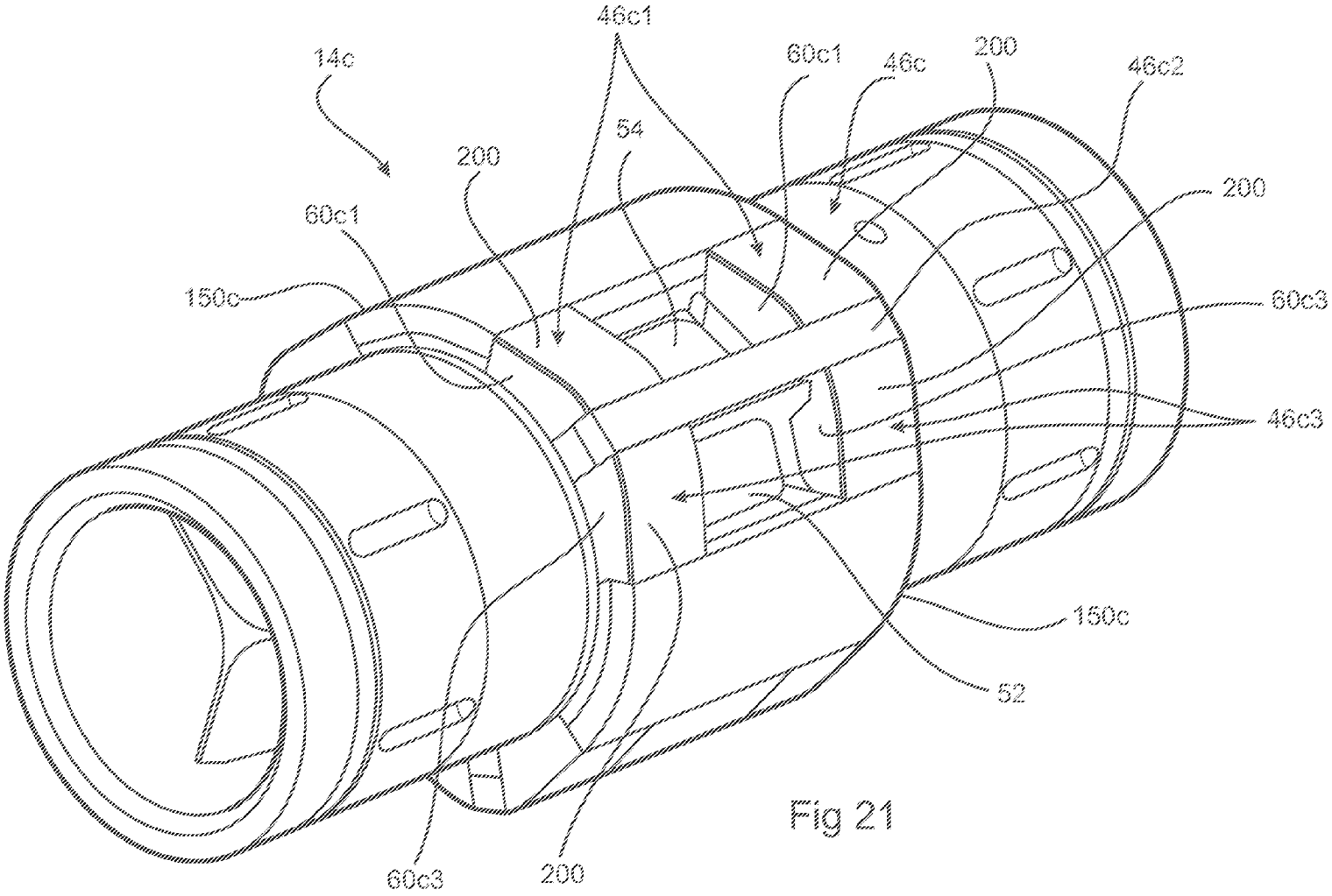
FIG. 21 is a representation of a stator that may be incorporated in the above embodiments of the machine.

FIG. 21 depicts a further aspect of a stator 14*c* that may be incorporated in yet a further embodiment of the machine 10. The stator 14*c* is generally similar to the stator 14' depicted in FIGS. 19 and 20 but is provided with a different configuration of lining blocks 150*c* and detachable lobe portions 46*c*. However the lobe portions 46*c* are provided as a plurality of portions, namely an ascending portion 46*c*, a crest portion 46*c*2, and a descending portion 46*c*3. Also while the lining blocks 150*c* are similar to the lining blocks 150 depicted in FIG. 18 they do not have the castellations provided by the spaced apart recesses 182. Rather the opposite sides 178*c* and 180*c* of the liner 150 are straight.

The crest portion 46*c*2 is in the form of a substantially rectangular bar but having an upper surface that is convexly curved to substantially match the curvature of the inner circumferential surface of a rotor 12 of a corresponding machine 10. The portion 46*c*2 may be made from many materials including for example ceramic materials, composite materials, and plastics such as PEK or PEEK.

The ascending lobe portions 46*c*1 comprise in essence respective magnets 60*c*1 each provided with a protective coating layer 200. The layer 200 is configured to form a smooth continuum between an adjacent insert 150*c* and crest piece 46*c*2. The layer 200 may be made from many materials including for example ceramic materials, composite materials, and plastics such as PEK or PEEK. The magnets 60*c*1 are disposed on axially opposite sides of an associated port 54. The magnets 60*c*1 are in the form of variable magnetic field magnets of a similar construction to the magnet 60*v* described herein before in relation to FIGS. 11 and 12.

The descending portion 46*c*3 is in substance a mirror image of the portion 46*c*1. In this regard the portion 46*c*3 comprises two magnets 60*c*3 one on either side of an associated port 52 with each magnet 60*c*3 being provided with a protective layer 200. The layer 200 on the descending portions 46*c*3 form a continuum between the crest piece 46*c*2 and the circumferentially adjacent insert 150*c*.

In this embodiment the magnets 60*c*1 and 60*c*3 are arranged to have substantially symmetrical magnetic fields. However this is no requirement in every embodiment. In particular the magnetic fields of the respective magnets 60*c*1 and 60*c*3 may differ from each other depending on the design requirements for the associated machine. A benefit of this embodiment is that it enables designers to use the magnetic fields of the magnets 60*c*1 and 60*c*3 to control the position of the gate as it moves up and down the lobe 46*c*. In some instances it may be desirable to have the magnets 60*c*1 and 60*c*3 to have symmetrical magnetic fields. However in other embodiments it may be beneficial for the magnetic field for the magnets 60*c*1 and 60*c*3 to be different. One effect achievable by using magnets of predesign magnetic field strength is to control the position of the gates 18 so as to maintain a substantially constant spacing from the surface of the lobe 46*c* as it traverses the ascending and descending portions.

Figure 22:
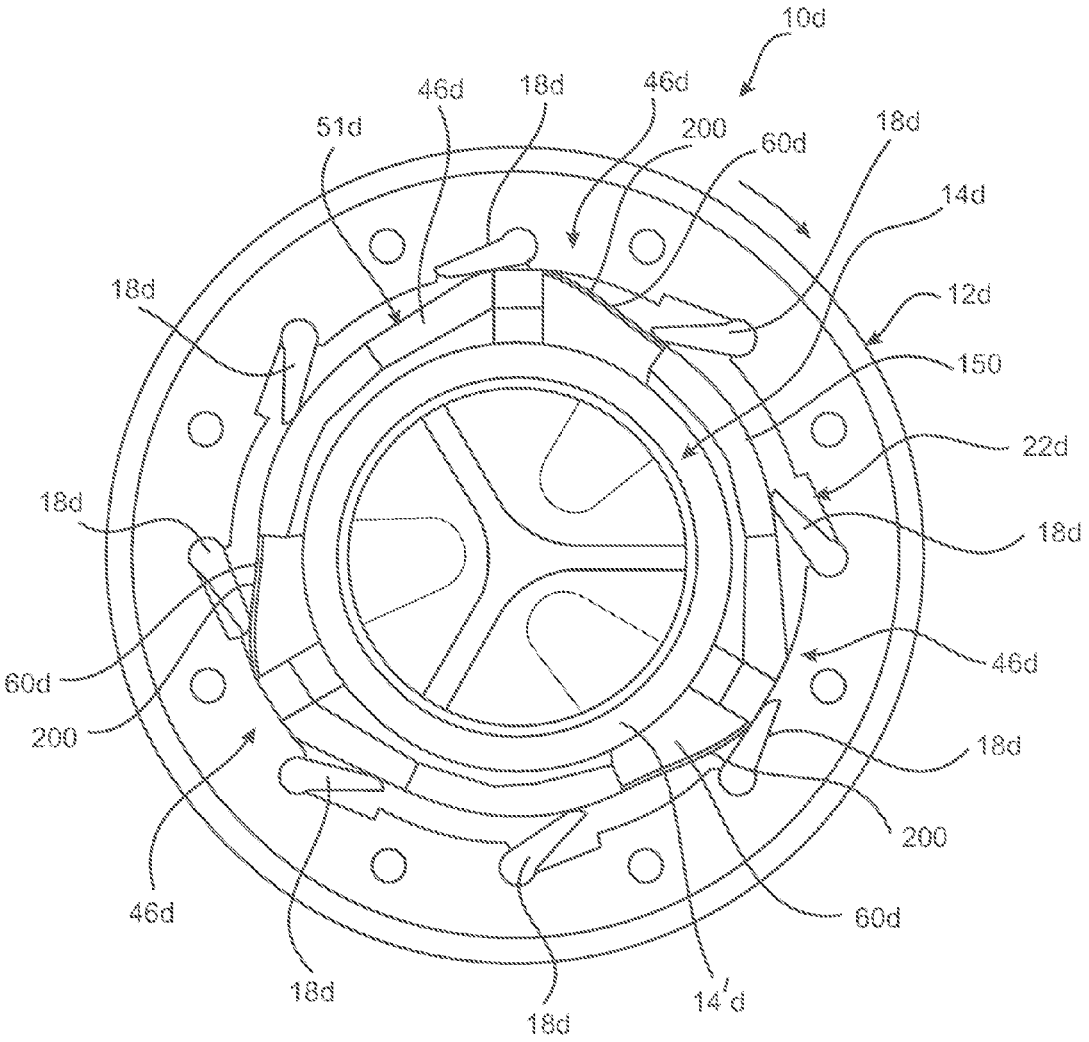
FIG. 22 is a schematic representation of a swinging gate embodiment of the rotary fluid machine.

FIG. 22 is an end view of an embodiment of the machine 10*d* in the form of a motor provided with swinging gates 18*d*. The machine 10*d* is provided with a stator 14*d* of substantially similar form to the stator 14*c* as shown in FIG. 21. The main difference between the stators 14*c* and 14*d* is the provision of magnets 60*d* on the descending side 53*d* only of each of the lobes 46*d*. Thus in this embodiment the magnetic gate control system is operable to provide bias to move the gates 18*d* to their respective extended positions on the descending side 53*d* only of a lobe 46*d*. Movement of a gate 18*d* in the refraction direction so as to move into their respective seats 22*d* is provided by mechanical engagement of an ascending side 51*d* of a lobe 46*d*.

The stator 14*d* comprises a stator or second body super structure 14'*d* provided with replaceable and separately made lining blocks 150*d* and lobes 46*d*. The lining blocks 150*d* may be the same as lining blocks 150 or 150*c*. Each lobe 46*d* comprises an ascending lobe portion 46*d*1, a crest portion 46*d*2, and descending crest portion 46*d*3. The ascending lobe portion 46*d*1 and the lining block 150*d* may be made from the same material. The ascending lobe portion 46*d*1 comprises two ramps axially spaced apart on opposite sides of an exhaust port. The ramps provide a continuous run or surface between an adjacent lining block 150*d* and crest portion 46*d*2. The descending lobe portion 46*d*3 may be of identical configuration to the descending lobe portion 46*c*3.

The rotor 12*d* is a similar form to the rotor 12 shown in FIG. 4. However the slots 22*d* are of a different configuration in order to accommodate the different configuration and motion of the corresponding gates 18*d*. Each of the gates 18*d* swings about an axis that extends in an axial direction of the motor 10*d*. The rotor 12*d* rotates in a clockwise direction with reference to the depiction in FIG. 22. High pressure fluid enters the working chamber between the rotor 12*d* and stator 14*d* via high pressure ports. The high pressure ports are disposed between the magnets 60*d*. The magnets 60*d* operate to move the gates 18*d* to the extended position as the gate traverses the descending side 53*d* of the lobe 46*d*. This ensures that the gates 18*d* are in the correct position to minimise bypass flow and maximise efficiency.

In a further variation (not shown) if desired magnets may also be provided on the ascending side 51*d* of each lobe 46*d* to assist the gate 18*d* in tracking a lobe 46*d* as the rotor 12*d* rotates about the stator 14*d*.

A further possible variation is in relation to the configuration of the hub of the stator 14. Looking at FIG. 1 it is seen that a right angle is formed between each end plate 57 of the rotor 16 and the outer circumferential surface of the hub 38 of stator 14. Consequently the gates 18 have right angles in their lower corners. Right angles are often difficult to seal. These right angle corners can be eliminated by extending the end faces 66 of the hub 38 radially to form two radially extending circumferential flanges and subsequently machining smoother curves on the inside of the flanges adjacent the circumferential surface of the hub 38. The gates 18 are then formed with complementary curved lower corners. This configuration has the additional benefit of enabling the provision of a further rotary seal between the radially outermost portions of the flanges and the rotor 16.

Whilst a number of specific embodiments have been described, it should be appreciated that the machine and method of operation may be embodied in many other forms. Moreover, many of the features of one embodiment may be interchanged with or incorporated in other embodiments. For example the aspect of the machine depicted in FIG. 10 relating to the number of lobes and gates may incorporate a conventional gate control system for example one that incorporates or uses cams to cause motion of the gates; or may alternately incorporate a magnetic gate control system as described in relation as to the aspects shown in FIGS. 1-9 or 12 and 13. Further, the aspect of the machine depicted in FIG. 16 in which the first and second bodies 12', 14' are formed as respective super structures and corresponding demountably coupled and separately made lining blocks or pieces may incorporate the aforementioned magnetic gate control systems; or alternately the conventional cam operated gate control system.

In the claims which follow, and in the preceding description, except where the context requires otherwise due to express language or necessary implication, the word "comprise" and variations such as "comprises" or "comprising" are used in an inclusive sense i.e. to specify the presence of the stated features but not to preclude the presence or addition of further features in various embodiments of the machine and method as described herein.

The invention claimed is:

1. A rotary fluid machine comprising:

first and second bodies, the bodies being rotatable relative to each other about an axis of rotation, the axis of rotation forming an axial direction of the machine, the bodies being arranged one inside the other to define a working fluid space there between;

a working fluid intake and a working fluid exhaust together forming an axial flow path being co-axial with the axial direction and enabling working fluid to flow into and out of the machine in an axial direction wherein the working fluid space is in fluid communication with the intake and the exhaust;

at least one gate carried by or otherwise coupled with the first body and being movable with respect to the bodies; and a magnetic gate control system operable to exert control of motion of the at least one gate.

2. The rotary fluid machine according to claim 1 wherein the magnetic gate control system is operable to move the at least one gate in an extension direction to extend the at least one gate from the first body toward the second body.

3. The rotary fluid machine according to claim 1 wherein the magnetic gate control system is operable to displace the at least one gate in a retraction direction to retract the at least one gate toward the first body.

4. The rotary fluid machine according to claim 1 wherein the magnetic gate control system is operable to move the at least one gate in either one or both of: (a) an extension direction to extend the at least one gate from the first body toward the second body; and (b) a retraction direction to retract the at least one gate towards the first body.

5. The rotary fluid machine according to claim 1 wherein the magnetic gate control system comprises one or more magnets fixed to one or both of the first body and the second body.

6. The rotary fluid machine according to claim 5 wherein at least one of the magnets is an electro-magnet.

7. The rotary fluid machine according to claim 5 wherein the one or more magnets are hermetically sealed on the body or bodies to which they are fixed.

8. The rotary fluid machine according to claim 5 wherein the magnetic gate control system comprises a plurality of magnets arranged in a Halbach array configuration.

9. The rotary fluid machine according to claim 5 wherein the one or more magnets are fixed to the second body and the one or more magnets comprise a first set of at least one magnet arranged to apply a force of attraction to move the gates toward the second body.

10. The rotary fluid machine according to claim 9 wherein the one or more magnets fixed to the second body comprise a second set of at least one magnet arranged to apply a force of repulsion to move the gates toward the first body.

11. The rotary fluid machine according to claim 10 wherein the one or more magnets fixed to the second body comprise a third set of at least one magnet arranged to apply a force of attraction to hold the gates near the second body, the third set of magnets being on a side of the first set of magnets opposite the second set.

12. The rotary fluid machine according to claim 9 comprising at least one lobe on the second body across which the at least one gate traverses wherein the at least one lobe has a crest that lies in close proximity to the first body and the first set of at least one magnet extends along one side of the at least one lobe toward the crest.

13. The rotary fluid machine according to claim 12 wherein the one side of the crest leads to an adjacent fixed diameter portion of the second body and wherein the first set of magnets comprises a first one piece magnet that spans from a first location adjacent the crest to a second location adjacent the fixed diameter portion and wherein the first one piece magnet has a constant or a variable magnetic field in the direction of rotation between the first and second locations.

14. The rotary fluid machine according to claim 13 wherein each one piece magnet has a planar base on a radial inner side of the one piece magnet that is inclined relative to a tangent plane of an immediately adjacent portion of the second body.

15. The rotary fluid machine according to claim 13 wherein the first one piece magnet has a radial outer surface of a profile substantially the same as that of the one side of the lobe.

16. The rotary fluid machine according to claim 1 wherein the gate is:

(a) made of a ferromagnetic material and the gate forms part of the magnetic gate control system;

(b) a magnet and the gate forms part of the magnetic gate control system; or, (c) provided with one or more gate magnets and the gate magnets form part of the magnetic gate control system.

17. The rotary fluid machine according to claim 1 wherein the gates are tapered on opposite radially extending sides in a manner so that an axially extending side of the gate closest the second body is shorter in length than an opposite axially extending side of the gate.

18. The rotary fluid machine according to claim 1 wherein the magnetic gate control system is further arranged to space the gates from opposite radial sided of the first body.

19. The rotary fluid machine according to claim 1 comprising M gates where M is an integer, wherein the second body is provided with N lobes wherein M>N and M/N is a non-integer >1.

20. The rotary fluid machine according to claim 1 wherein the machine is bi-directional.

21. The rotary fluid machine according to claim 1 comprising at least one lobe on the second body across which the at least one gate traverses, with a working fluid inlet and a working fluid outlet provided on respective circumferentially opposite sides of the at least one lobe wherein working fluid is able to enter and exit the working fluid space through the inlet and out respectively.

22. The rotary fluid machine according to claim 1 comprising a manifold located between the working fluid intake and the working fluid exhaust, the manifold configured to divert an axial flow of fluid entering from the working fluid intake to flow in a radial outward direction into the working fluid space, and subsequently divert working fluid in the working fluid space in a radial inward direction to exit from working fluid exhaust in the axial direction.

23. A method of operating a rotary fluid machine having first and second bodies, the bodies being rotatable relative to each other about an axis of rotation, the axis of rotation forming an axial direction of the machine, the bodies being arranged one inside the other to define a working fluid space there between, a working fluid intake and a working fluid exhaust forming an axial flow path being co-axial with the axial direction and enabling working fluid to flow into and out of the machine in an axial direction wherein the working fluid space is in fluid communication with the intake and the exhaust, and at least one gate, the at least one gate being carried by or otherwise coupled with the first body and movable with respect to the bodies, the method comprising magnetically controlling motion of the gates for at least one portion of a cycle of the rotation of one of the bodies relative to the other.

24. The method according to claim 23 wherein magnetically controlling motion of the gates comprises magnetically biasing the gates to move toward the second body for a plurality of first portions of the cycle of rotation.

25. The method according to claim 24 wherein magnetically controlling motion of the gates comprises magnetically biasing the gates to retract into the first body for a plurality of second portions of the cycle of rotation, wherein the second portion are interleaved with the first portions.

26. The method according to claim 23 wherein magnetically controlling motion of the gates comprises one of: (a) providing one or magnets in or on the second body to produce a magnetic field capable of inducing the motion of gates; (b) providing one or magnets in or on the first body to produce a magnetic field capable of inducing the motion of gates; (c) providing one or magnets in or on the gates to produce a magnetic field capable of inducing the motion of gates; or, (d) forming the gates of a ferromagnetic material.

27. The method according to claim 26 comprising, when a plurality of magnets is provided, arranging the magnets in a Halbach array.

28. The method according to claim 23 comprising magnetically levitating the gates.

* * * * *